US012420380B2

(12) United States Patent
Blange

(10) Patent No.: US 12,420,380 B2
(45) Date of Patent: Sep. 23, 2025

(54) PARTICLE CONCENTRATING DEVICE, CONCENTRATOR ELEMENT AND ASSEMBLY THEREOF, METHOD FOR INCREASING CONCENTRATION, METHOD FOR DIRECTIONAL DRILLING AND USE OF THE ASSEMBLY

(71) Applicant: Canopus Drilling Solutions Holding B.V., S-Gravenhage (NL)

(72) Inventor: Jan Jette Blange, S-Gravenhage (NL)

(73) Assignee: CANOPUS DRILLING SOLUTIONS HOLDING B.V., 'S-Gravenhage (NL)

( * ) Notice: Subject to any disclaimer, the term of this patent is extended or adjusted under 35 U.S.C. 154(b) by 372 days.

(21) Appl. No.: 18/033,161

(22) PCT Filed: Oct. 19, 2021

(86) PCT No.: PCT/EP2021/078903

§ 371 (c)(1),
(2) Date: Apr. 21, 2023

(87) PCT Pub. No.: WO2022/084289

PCT Pub. Date: Apr. 28, 2022

(65) Prior Publication Data

US 2023/0390897 A1 Dec. 7, 2023

(30) Foreign Application Priority Data

Oct. 23, 2020 (NL) ..... 2026757

(51) Int. Cl.

| | |
|---|---|
| ***B24C 3/32*** | (2006.01) |
| ***B24C 9/00*** | (2006.01) |
| ***E21B 7/18*** | (2006.01) |

(52) U.S. Cl.

CPC ..... *B24C 3/32* (2013.01); *B24C 9/00* (2013.01); *E21B 7/18* (2013.01)

(58) Field of Classification Search

CPC ..... E21B 10/602; E21B 21/002; E21B 7/18; B24C 9/00; B24C 3/32; B24C 1/04

See application file for complete search history.

(56) References Cited

U.S. PATENT DOCUMENTS 3,026,789 A 3/1962 Mead
4,434,861 A * 3/1984 Howeth ..... E21B 21/015 175/209

(Continued)

FOREIGN PATENT DOCUMENTS

GB 1 359 775 7/1974
GB 2 033 258 A 5/1980

(Continued)

OTHER PUBLICATIONS

Dutch Search Report, issued in Priority Application No. 2026757, dated Jul. 9, 2021.

(Continued)

*Primary Examiner* — Yong-Suk (Philip) Ro
(74) *Attorney, Agent, or Firm* — Birch, Stewart, Kolasch & Birch, LLP

(57) ABSTRACT

The invention relates to increasing a concentration of particles (92) in a circumferentially enclosed stream (90) of a fluid mixed with the particles in a target area (90*ct*) of a cross-section (90*c*) of the stream transverse to a flow direction (90*f*) of the stream. Deflecting surfaces (31.1, 31.2, 31.3) are arranged in the stream to extend over respective angular zones (30α1, 30α2, 30α3) with respect to an axis (1*a*) through the target part. The deflecting surfaces slant in the flow direction in a direction from the circumference of the stream towards the target area, and define angularly in between them multiple bypass openings (32.1, 32.2, 32.3) which extend over angular zones complementary (30β1, 30β2, 30β3) to the angular zones over which the deflecting surfaces extend, and which are larger than the particles. The (Continued)

deflecting surfaces deflect at least a part of the particles inwardly towards the axis. A target part (90*t*) of the stream with the target cross-section around the axis is discharged through an outlet (20), and a remaining part (90*r*) is discharged through the openings, between the target part and the circumference of the stream, such as to discharge the stream as composed of the target part and the remaining part. The invention relates to an assembly comprising a circumferential enclosure and a particle concentrating device, a particle concentrating device, a concentrator element, a method for increasing a concentration of particles, a method for directional drilling and the use of the assembly.

26 Claims, 12 Drawing Sheets

(56) References Cited

U.S. PATENT DOCUMENTS 4,768,709 A * 9/1988 Yie ..... B24C 5/02 239/336
5,606,139 A * 2/1997 Wittig ..... G01N 1/08 73/864.45
5,718,298 A * 2/1998 Rusnak ..... E21B 21/063 166/267
7,398,839 B2 * 7/2008 Harder ..... E21B 21/063 175/54
2006/0021798 A1 2/2006 Tibbitts
2006/0266554 A1 11/2006 Blange
2008/0023033 A1 * 1/2008 Potter ..... E21B 27/04 134/10
2010/0078217 A1 4/2010 Blange
2012/0006757 A1 * 1/2012 Lehman ..... E21B 43/35 210/747.1
2012/0255792 A1 10/2012 Blangé et al.

FOREIGN PATENT DOCUMENTS

NL 2024001 B1 6/2021
WO WO 2012/084934 A1 6/2012

OTHER PUBLICATIONS

International Search Report, issued in PCT/EP2021/078903, dated Feb. 1, 2022.
Written Opinion of the International Searching Authority, issued in PCT/EP2021/078903, dated Feb. 1, 2022.

* cited by examiner

▼ Fig. 1a
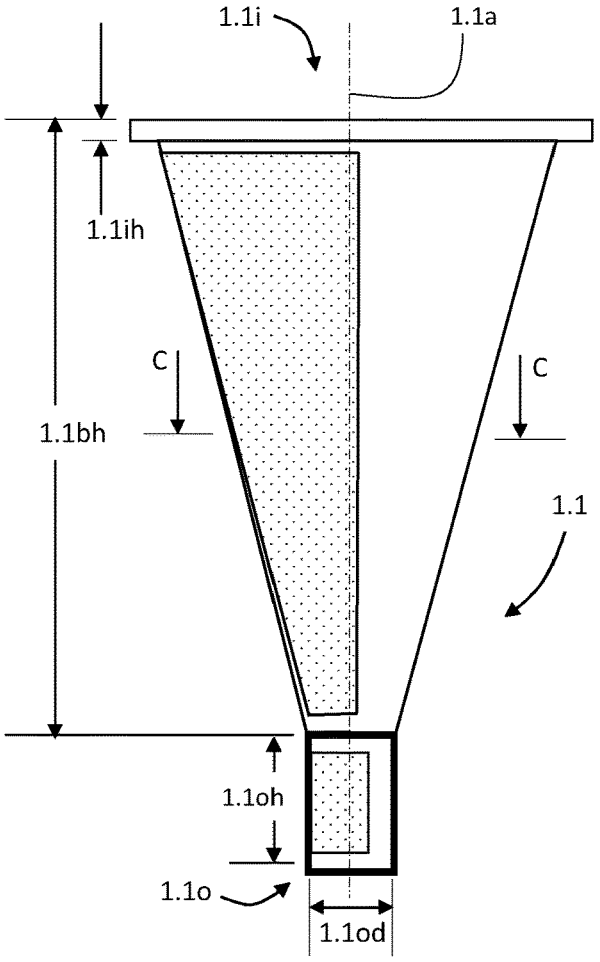
▼ Fig. 1c
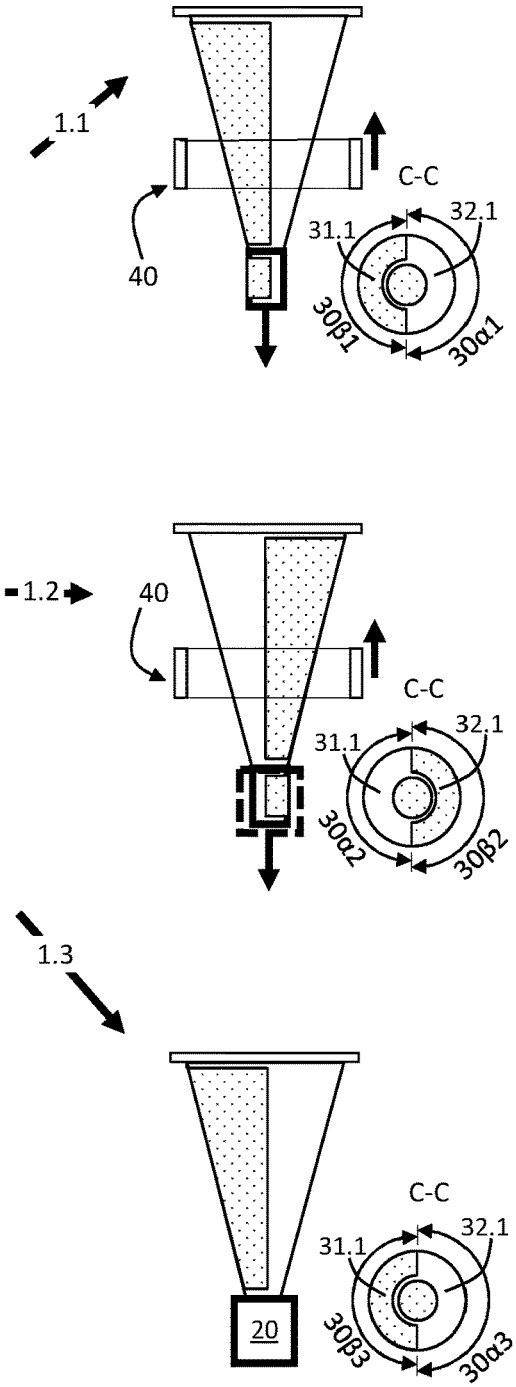
▼ Fig. 1b
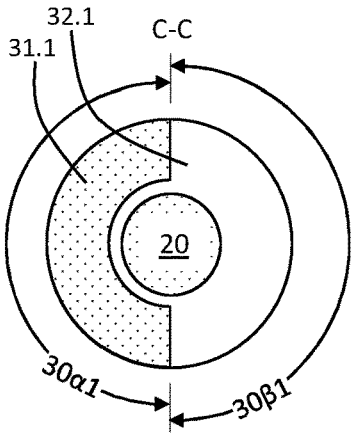

▼ Fig. 1d
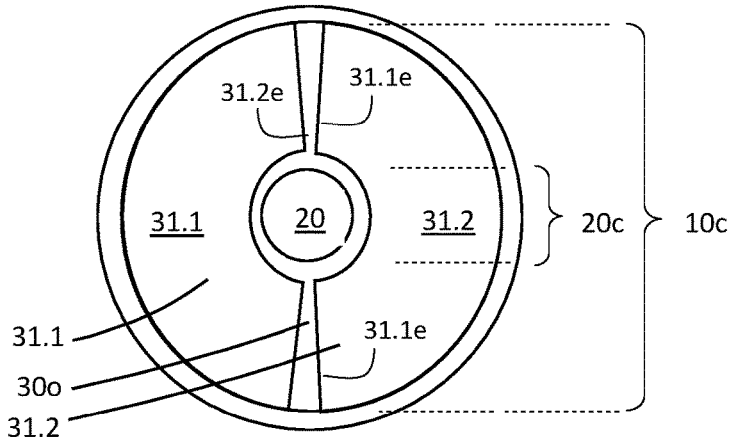
▼ Fig. 1e
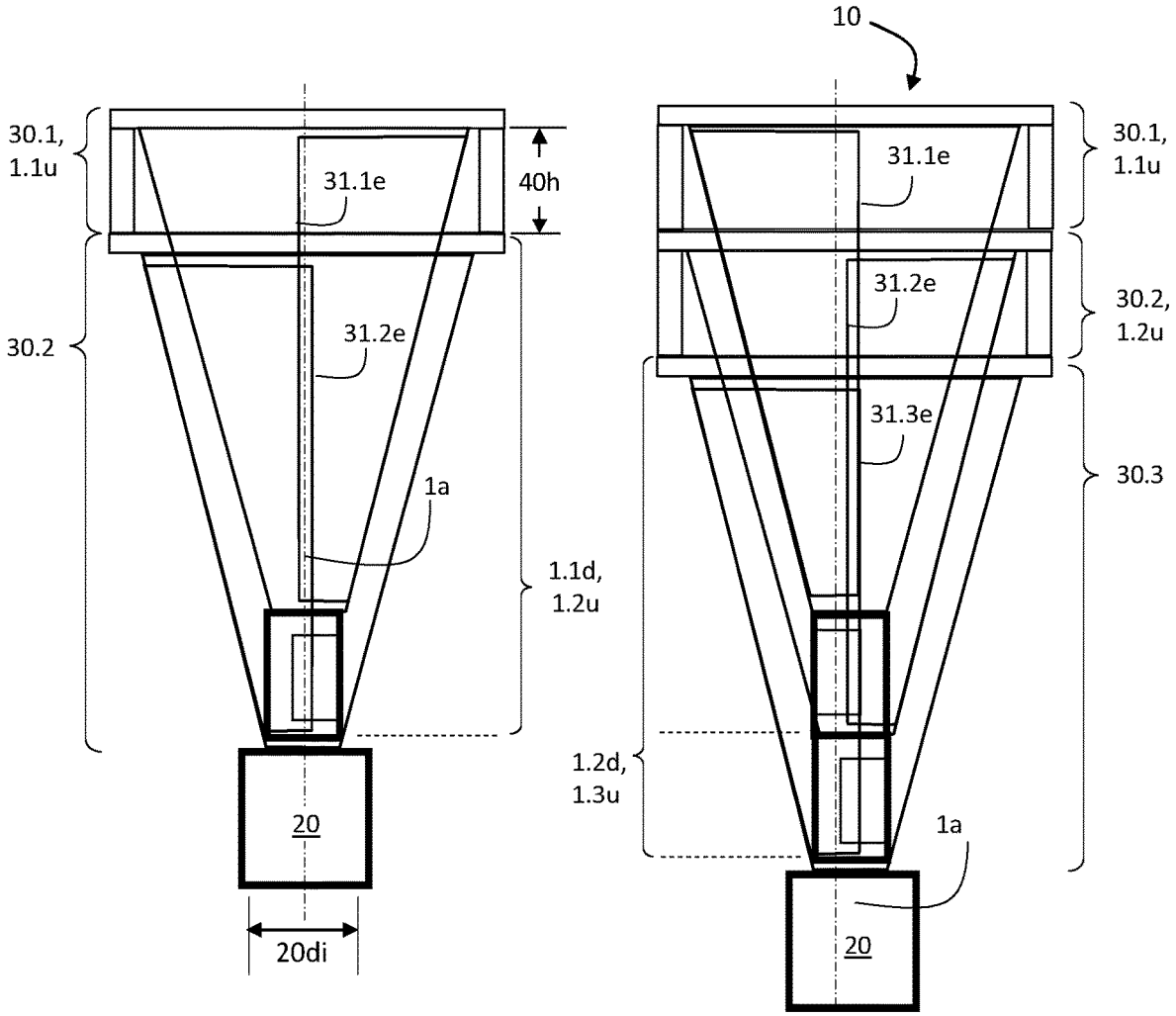

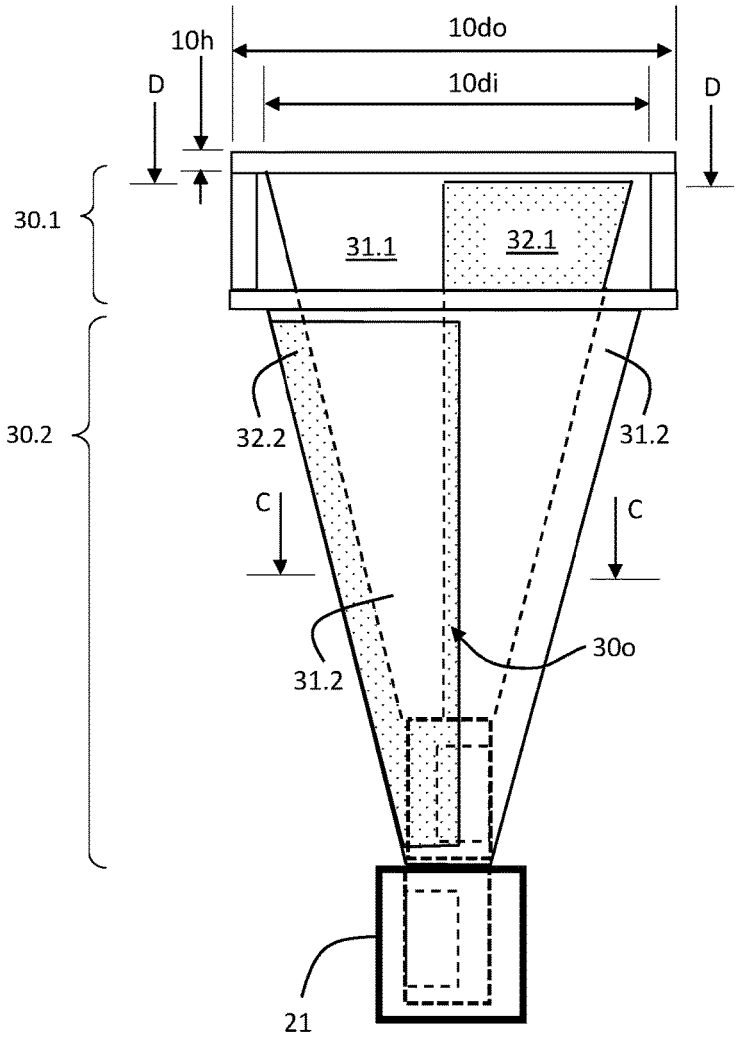
▲ Fig. 1f
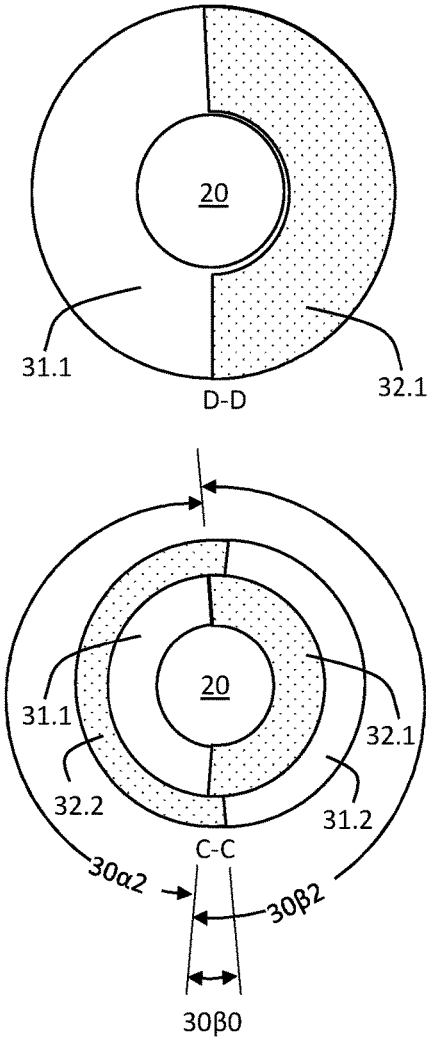
▲ Fig. 1g
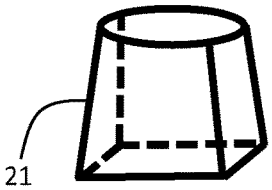
▲ Fig. 1j

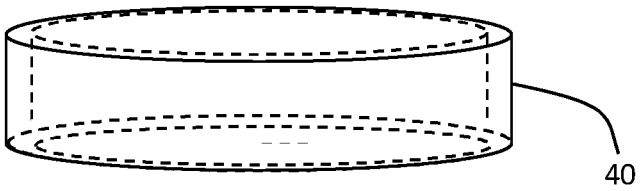
▲ Fig. 1k
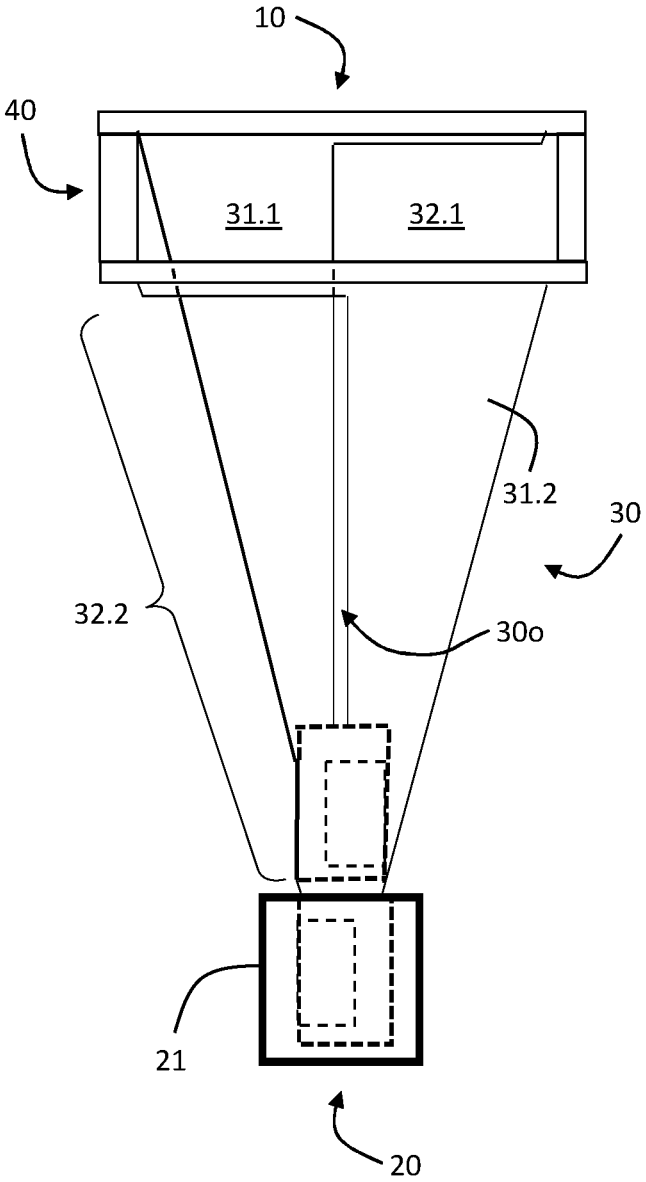
▲ Fig. 1h
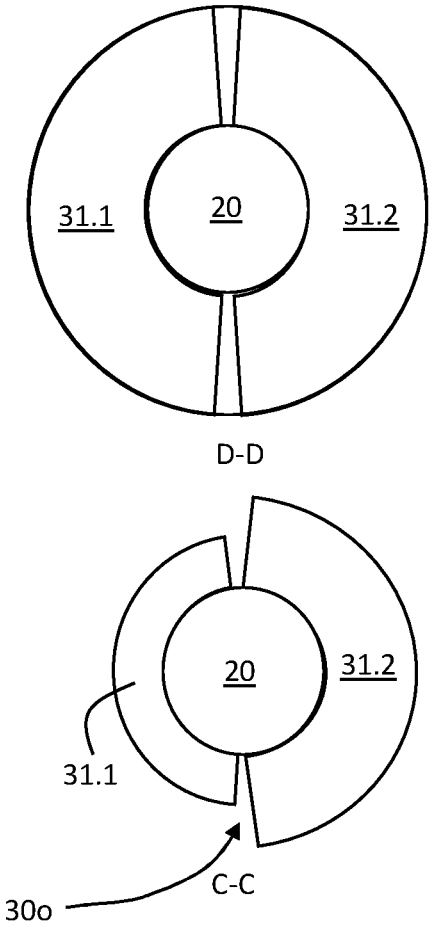
▲ Fig. 1i

▼ Fig. 2a
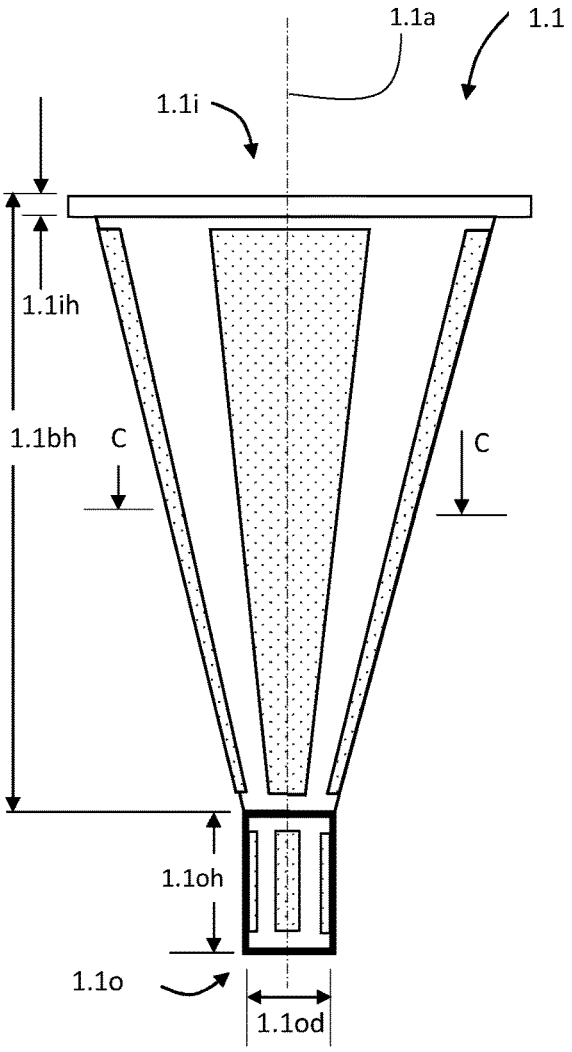
▼ Fig. 2c
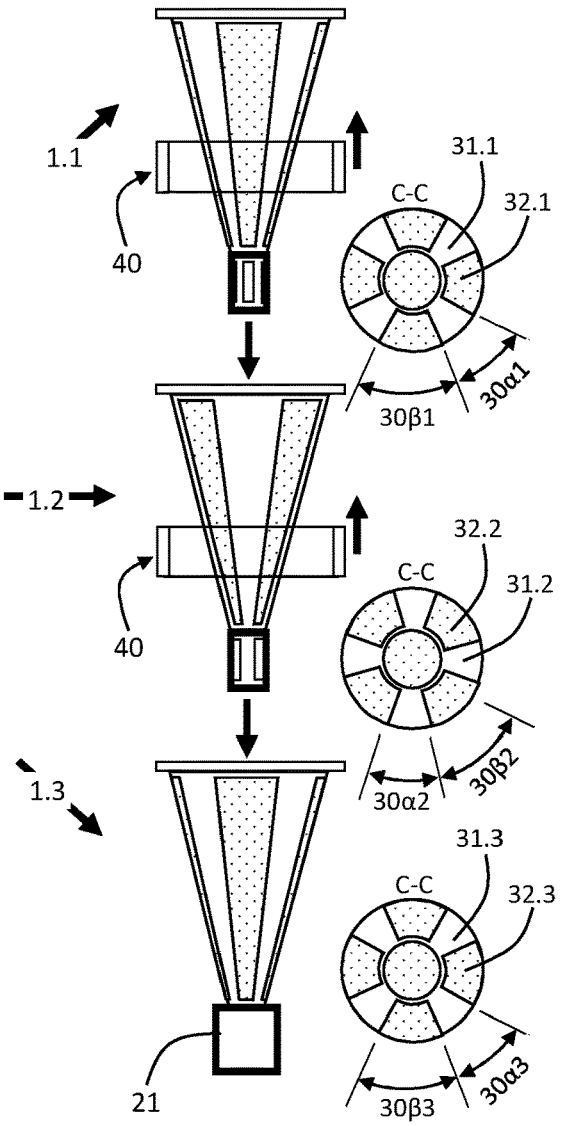
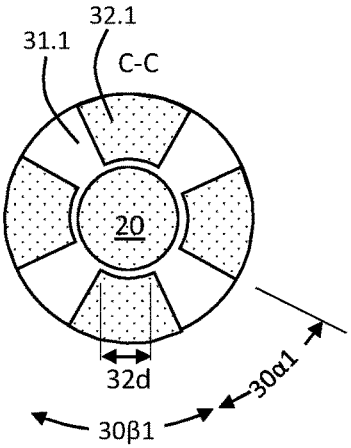
▲ Fig. 2b

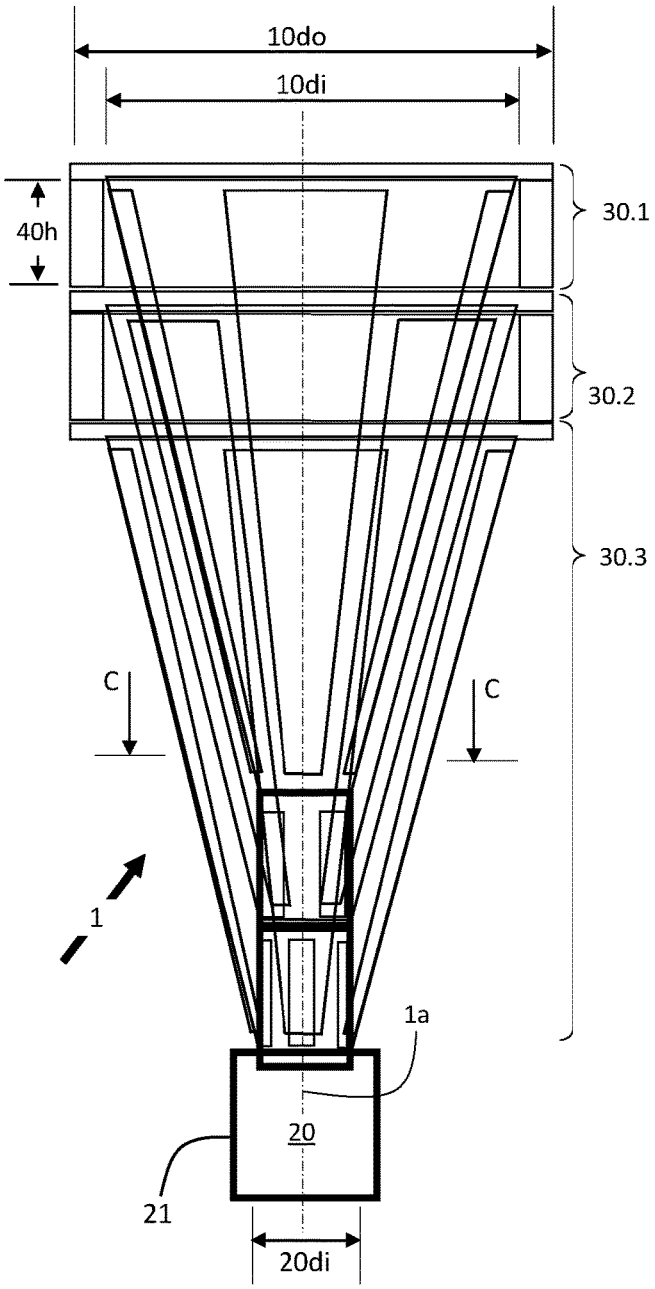
▲ Fig. 2d
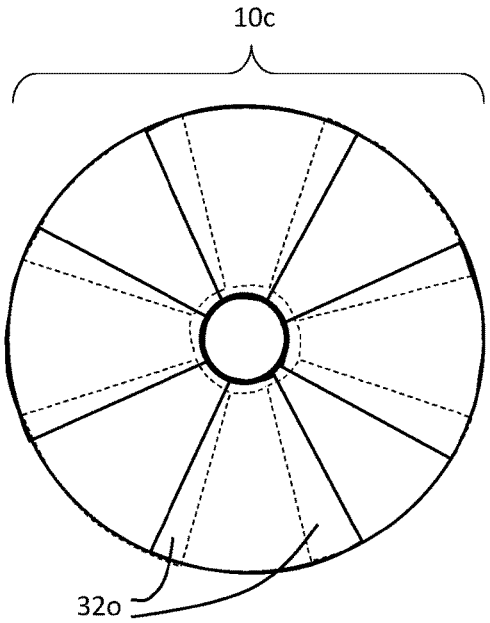
▲ Fig. 2e
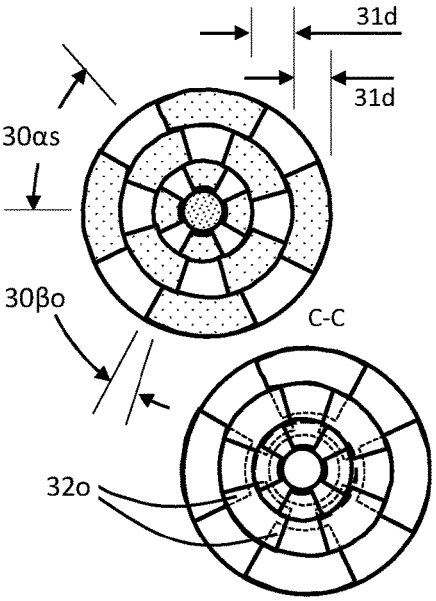
▲ Fig. 2f

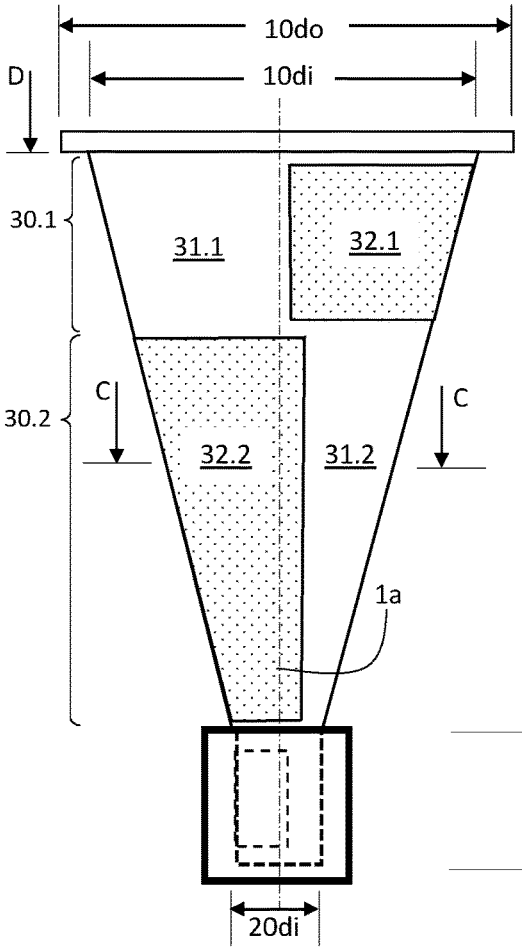
▲ Fig. 3a
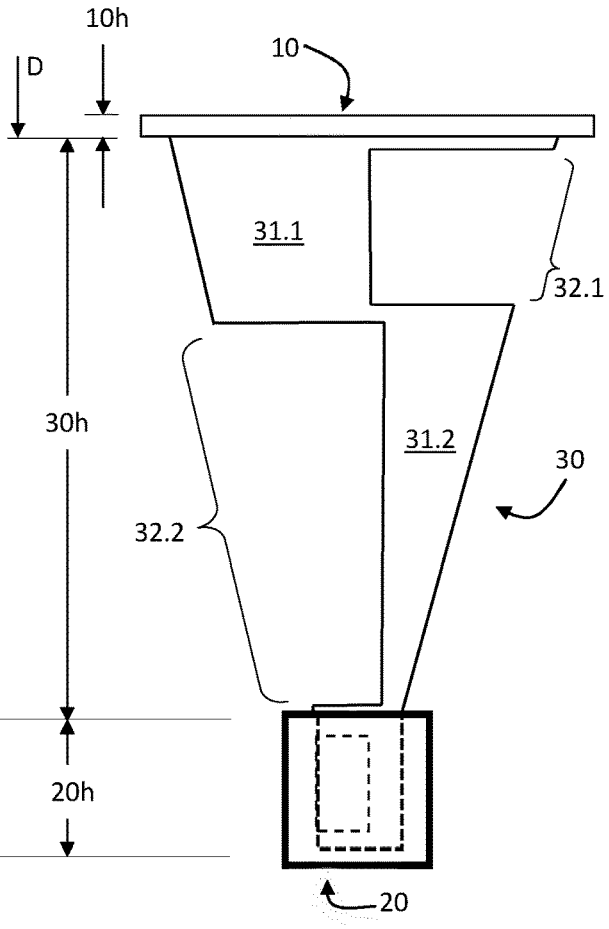
▲ Fig. 3b
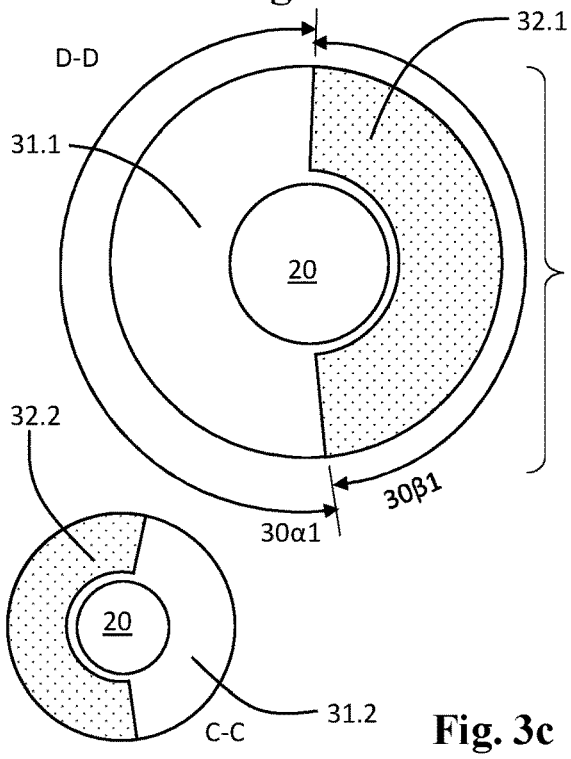
Fig. 3c
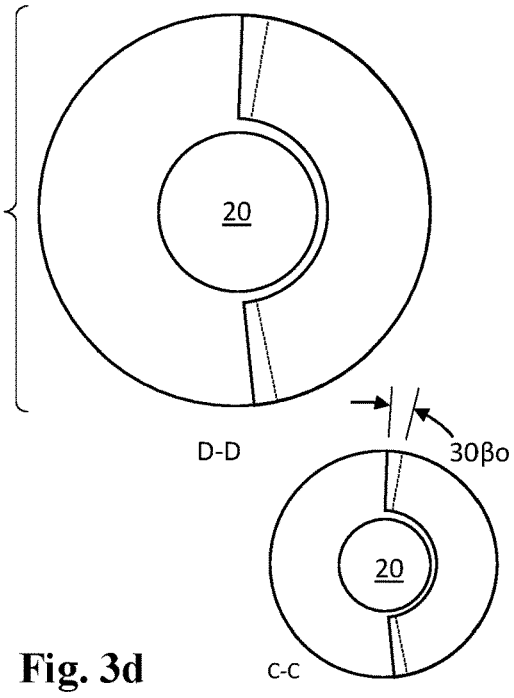
Fig. 3d

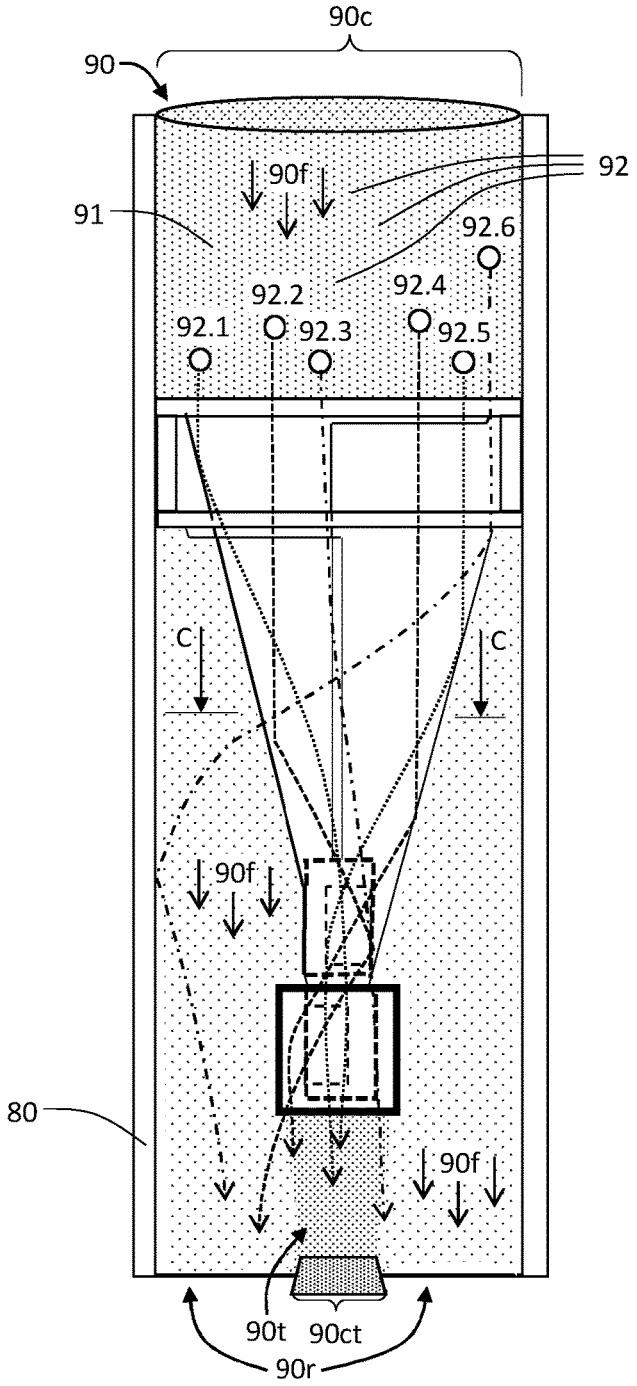
▲ Fig. 4a
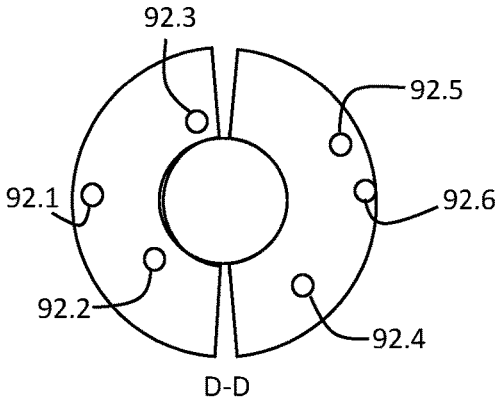
▲ Fig. 4b
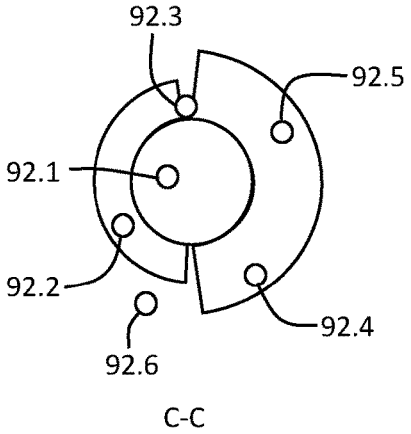
▲ Fig. 4c

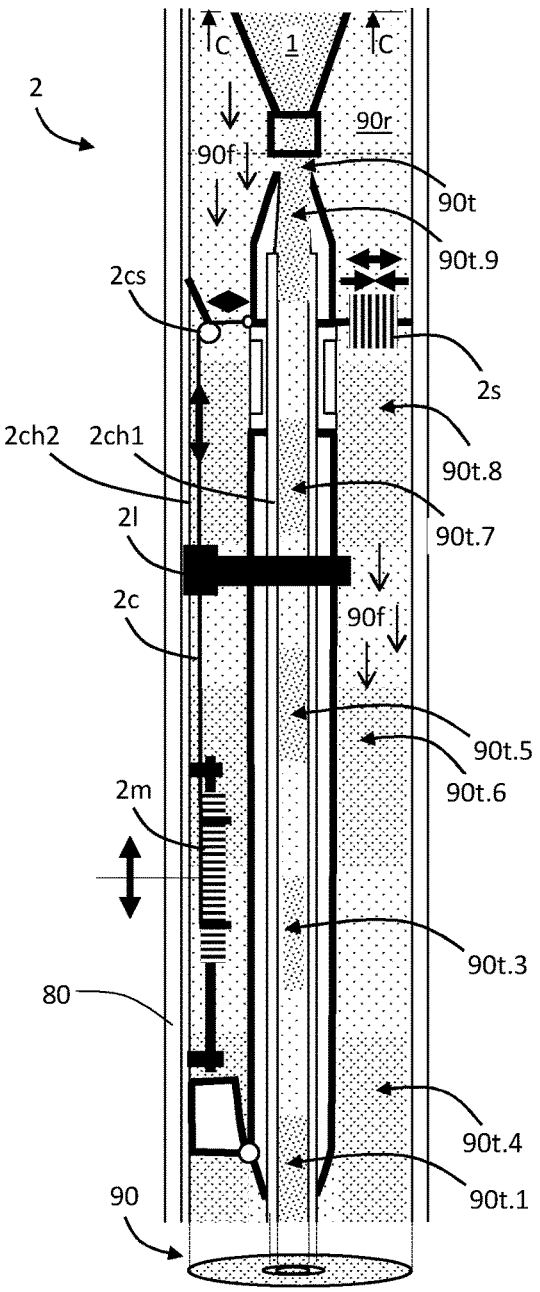
▲ Fig. 5a
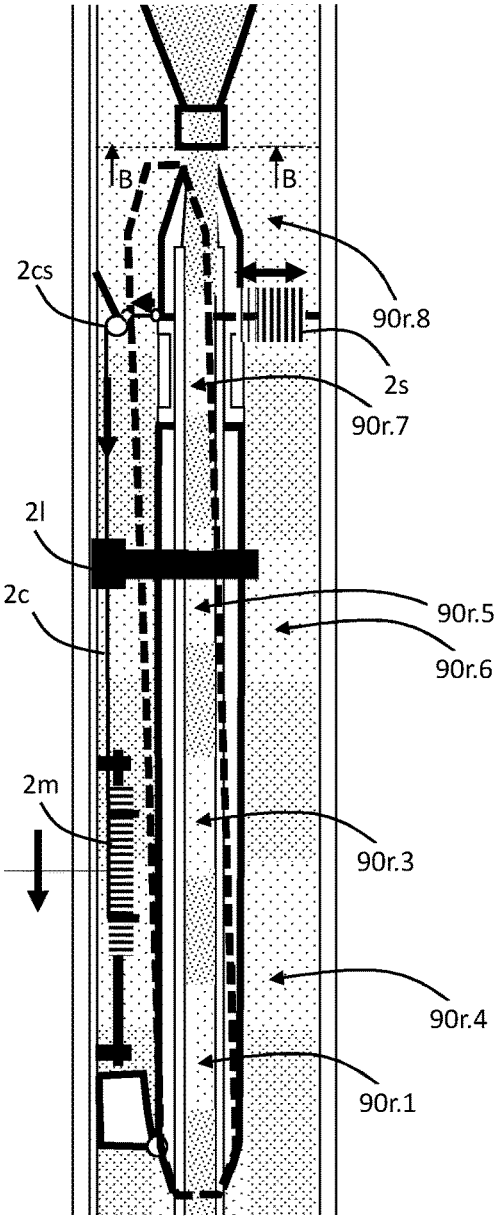
▲ Fig. 5b
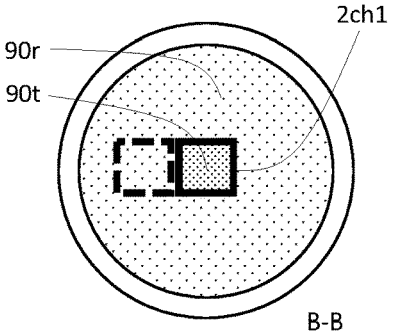
▲ Fig. 5c
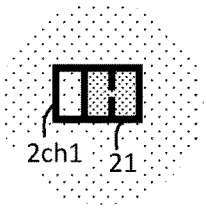
▲ Fig. 5d

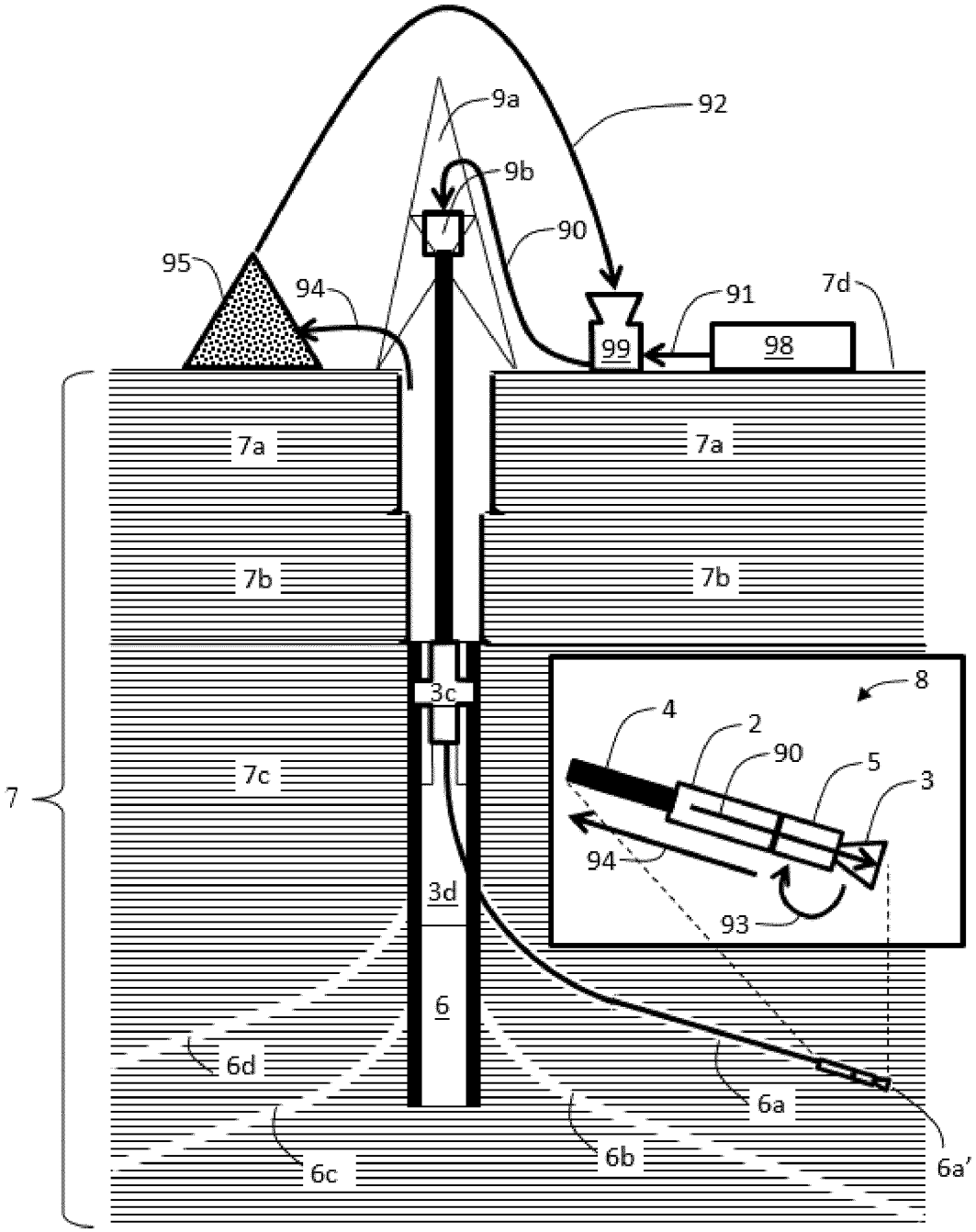
▲ Fig. 6a

▼ Fig. 6b ▼ Fig. 6c ▼ Fig. 6d
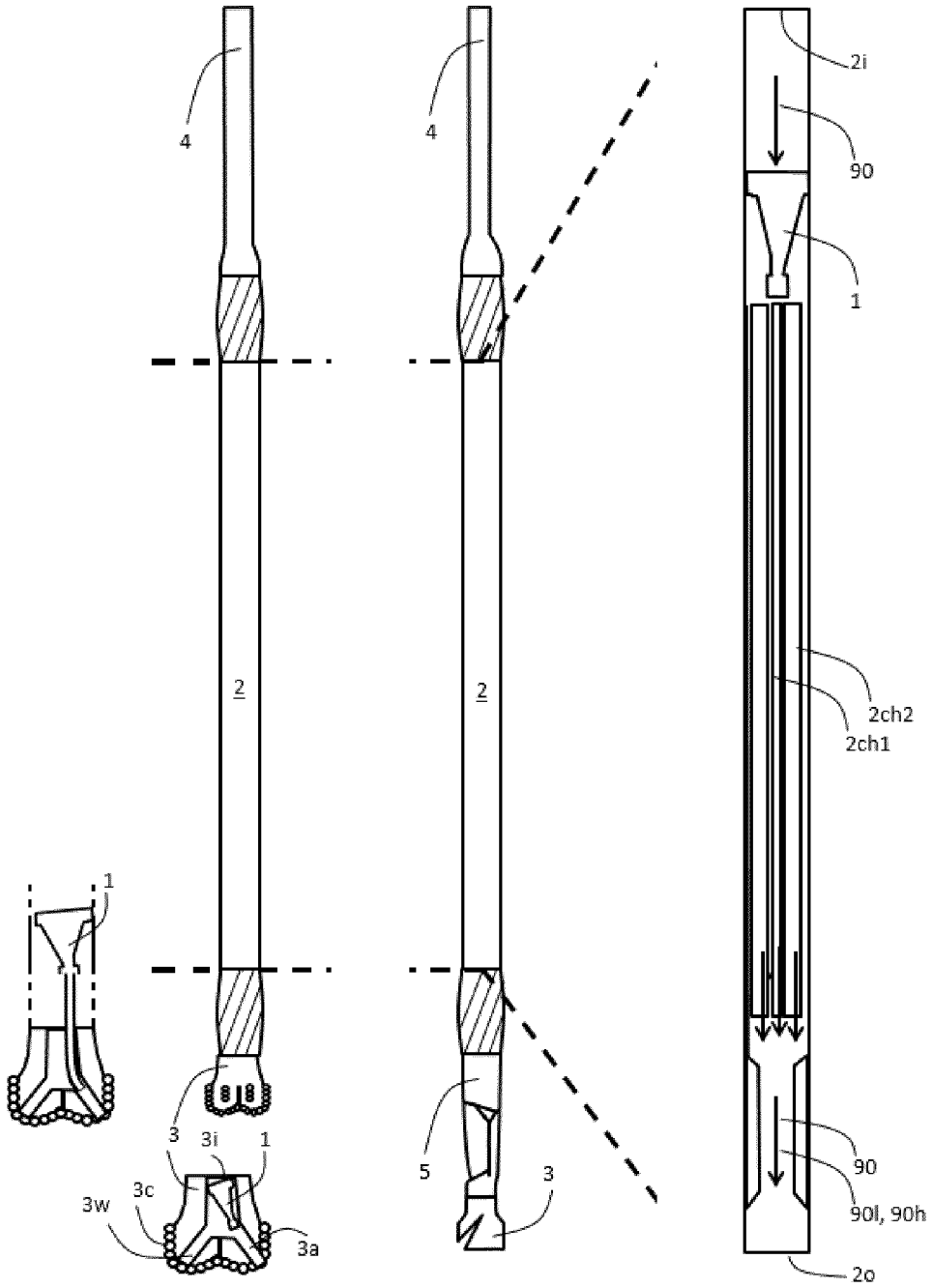

▼ Fig. 6e
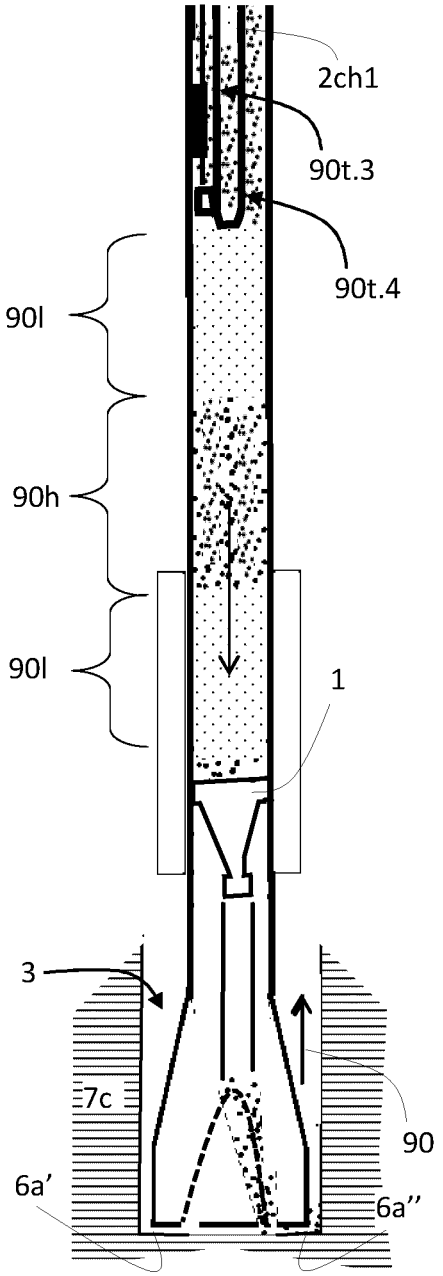
▼ Fig. 6f
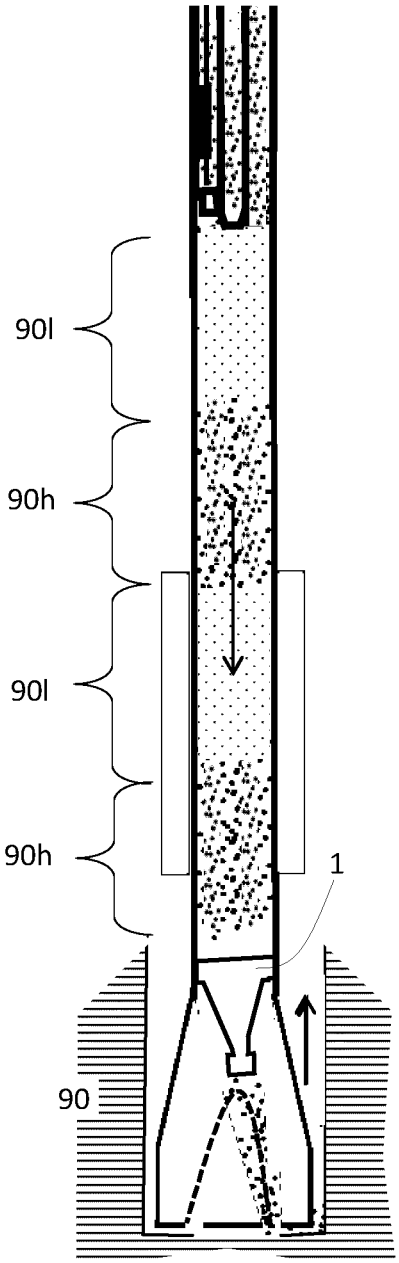

PARTICLE CONCENTRATING DEVICE, CONCENTRATOR ELEMENT AND ASSEMBLY THEREOF, METHOD FOR INCREASING CONCENTRATION, METHOD FOR DIRECTIONAL DRILLING AND USE OF THE ASSEMBLY

FIELD OF THE INVENTION

The invention relates to a device and method for concentrating particles within a stream of fluid mixed with these particles.

BACKGROUND OF THE INVENTION

In particular in applications employing abrasive particles for abrasive blasting or cutting or drilling by means of, or assisted by, an abrasive jet, it may be desired to increase the concentration of abrasive particles within a stream of fluid mixed with the abrasive particles.

For example, it may be desired to form a target stream part with a high concentration of abrasive particles and a remaining stream part with a low concentration of abrasive particles.

For example in the abrasive jet drilling system of US2006/021798 multiple vibrating classifiers are employed to salvage a portion of the abrasive particles from a stream of drilling fluid mixed with abrasive particles. The abrasive jet drilling systems of GB1359775 and GB2033258 employ centrifugal forces for separating abrasive particles from the remainder of the stream. U.S. Pat. No. 3,026,789 discloses the use of obstacles within a discharge stream of air and abrasive particles used for abrasive blasting for a separation.

It may, e.g. simultaneously with the forming of the target part and the remaining part of the stream, be desired to radially direct the target part of the stream with the increased concentration of abrasive particles towards a target part of a cross-section of the stream transverse to a flow direction of the stream, e.g. while directing the remaining part of the stream towards a remaining part of the cross-section.

A particular example application in which directing abrasive particles of a supply stream towards a target part of the cross-section is desired, is directional abrasive jet drilling, wherein a stream of drilling fluid mixed with abrasive particles is brought into impingement with a borehole bottom in order to erode the borehole bottom thereby deepening the borehole. Therein, varying the extent of erosion such that it is smaller in an azimuthal section of the borehole bottom than in an opposite azimuthal section, makes the borehole deviate in the direction of the less eroded section. By this principle a bent borehole section may be drilled. To achieve this, the stream of abrasive particles mixed with drilling fluid is pumped from the surface towards the borehole bottom through a drill string, e.g. including a steering sub, and one or more nozzles of a drill bit of a directional drilling system. For varying the extent of erosion in the borehole sections, one possibility is to modulate the erosive power of the abrasive jet along the borehole sections, see e.g. US2006/0266554, which according to one example may be achieved by varying the concentration of the particles which impinge the borehole bottom along azimuthal positions of the borehole bottom—see e.g. NL2024001. To modulate the concentration, it may be required to direct the abrasive particles towards the associated azimuthal sections prior to passing the stream through the nozzles.

In abrasive jet drilling, the cross-section of the drill string and connected drill bit is limited by the cross-section of the borehole and substantially constant along the borehole trajectory. Correspondingly, the cross-section of the stream of drilling fluid mixed with abrasive particles is substantially constant in the flow direction. This makes that abrasive jet drilling systems configured for directional drilling require the separation of the stream into a high concentration target stream portion and a low concentration remaining stream part and the direction of the target stream portion and remaining stream portion to respective portions of the cross-section of the stream, to take place while maintaining a substantially constant stream cross-section.

Such concentration of abrasive particles towards a target cross-sectional part may be required both in the drill string and at the drill bit. For example, in the drill string, e.g. in a steering sub of the drill string, it may be required as a part of a mechanism for modulating a concentration of the abrasive particles over time, which is based on generating alternating stream portions with low and high particle concentration out of the target stream part and the remaining stream part. The high concentration portions may be passed through the nozzles of the drill bit when these are directed towards the section of the borehole bottom requiring more erosion, and the low concentration portions when the nozzles are directed towards the section to be eroded less, for achieving the directional effect. In the drill bit, the concentration may be required for providing increased and decreased concentrations of abrasive particles in selected respective angular zones of the rotational trajectories of nozzles which correspond to the azimuthal sections of the borehole bottom to be eroded to a larger and smaller extent.

WO2012084934 proposes for a directional abrasive jet drilling system a solids diverter in the form of a flat plate placed inside the drill bit inclined with respect to the flow direction such as to divert abrasive particles in a supply stream of drilling fluid mixed with abrasive particles towards an angular zone of a rotational trajectory of the inlet of a nozzle, in order for the diverted particles to pass through the nozzle only when it aligns with the azimuthal section of the borehole bottom which needs a larger extent of erosion. This solids diverter establishes an increased particle concentration in the mentioned angular zone and a decreased particle concentration in a remaining angular zone.

US2010078217 proposes for a directional abrasive jet drilling system in which the abrasive particles are ferromagnetic, a separator which separates and directs the abrasive particles based on their ferromagnetic properties.

The above solutions are not satisfactory and have multiple drawbacks.

For example, in the solids diverter of WO2012084934, the abrasive particles are caused to flow at an increased concentration along a part of an inner wall of the internal space of the drill bit. This may lead to increased wear of the particular wall part, and thus of the drill bit. Similarly, when used in the drill string, e.g. a steering sub, the wall of channels through which the stream is passed may suffer from increased wear when using this solids diverter for concentrating the particles towards a target cross-section. Furthermore, there is no possibility for modulating the concentrating effect of the diverter—for example in terms of the concentration difference between the target portion and the remaining portion of the stream.

US2010078217 requires the abrasive particles to be magnetic, as the separation of the particles from the drilling fluid is based on this property. Therefore the separator is not suitable for applications in which the abrasive particles are not magnetic. Furthermore, the separator requires electricity for establishing and moving the magnetic field—for which the supply of an undue amount of energy is required. This is especially disadvantageous given the downhole locations at which the particle concentration is required as this involves transferring the electricity over substantially the whole length of the drill string.

OBJECT OF THE INVENTION

The present invention aims to provide a device and method for forming the target part and the remaining part of a stream of fluid mixed with the particles, respectively with a higher and lower concentration of particles, and directing the target part towards the target cross-sectional part of the stream.

The present invention furthermore aims to provide such device and method which reduces wear of channels through which the stream passes, and/or which at least reduces, e.g. substantially eliminates, the consumption of energy required for the concentration and/or which enables the extent of the concentration increase to be modulated.

At least, the present invention aims to provide such a device and method which forms an alternative to the prior art solutions.

The present invention furthermore aims to provide such device and method for a stream in which the abrasive particles have an effective diameter of approximately 0.8-1.2 mm, e.g. 0.9 or 1 mm, preferably 1 mm.

SUMMARY OF THE INVENTION

According to the present invention, one or more of the objects are achieved by providing an assembly and a method.

An assembly according to the invention comprises:

a circumferential enclosure, e.g. a tube, for accommodating a stream of a fluid mixed with particles, e.g. the fluid being a drilling liquid, and the particles being abrasive particles, e.g. a steel shot, the stream having a cross-section defined by the circumferential enclosure transverse to a flow direction of the stream, and a particle concentrating device that extends around an axis parallel to the flow direction, and that is arranged inside and connected to the circumferential enclosure.

In an embodiment, the particle concentrating device comprises multiple concentrator elements which are successively arranged in the flow direction, e.g. partially nested inside each other, each concentrator element having one or more of the deflectors. In an alternative embodiment, the particle concentrating device comprises a single concentrator element having multiple deflectors.

The particle concentration device is configured for increasing a concentration of the particles in a target area of the cross-section of the stream, the target area being defined by an outlet of the particle concentrating device arranged at a downstream end thereof and having a cross-section corresponding to the target area. The device is arranged inside the circumferential enclosure to discharge within the circumferential enclosure the stream as being composed of a target part, discharged by the outlet, and a remaining part.

The particle concentrating device comprises multiple deflectors, the deflectors each having a deflecting surface. The deflecting surfaces:

are arranged about the axis, slanting in the flow direction from the circumferential enclosure towards the axis, for deflecting a part of the particles towards the axis, and thus towards the target area, extend over respective angular zones of the device with respect to the axis, the angular zones each being defined by side edges of the respective deflecting surface, the side edges preferably extending in an axial plane comprising the axis, the deflecting surfaces together extending over a collective angular zone between the angularly most remote side edges thereof, which angular zone covers a majority of the angular range around the axis, and define between the side edges thereof one or more bypass openings which thereby extend over angular zones complementary to the angular zones over which the deflecting surfaces extend.

In operation of the device, the deflecting surfaces together are configured for forming the target part discharged by the outlet of the device, and the bypass openings are together configured for discharging the remaining part of the stream between the circumferential enclosure and the outlet.

Furthermore, respective ones of the deflectors are part of multiple concentrator elements of the device which are successively arranged in the flow direction, e.g. nested inside each other. Each concentrator element has one or more of the deflectors, or the deflectors are all part of a single concentrator element.

According to the invention, the stream is converted into being composed of the target part with a high concentration of particles in a target part of a cross-section of the stream transverse to a flow direction of the stream, and the remaining part of the stream in a remaining part of the cross-section of the stream.

A method according to the invention is discussed after the following general discussion of the invention and of embodiments in relation to the device and the assembly.

The present invention thus provide a device and method that form an alternative to the prior art solutions.

An assembly and a method according to the invention therefore enable to form a target part and a remaining part in a stream of fluid mixed with the particles, respectively with a higher and lower concentration of particles. Thus, the stream is converted into being composed of the target part with a high concentration of particles in a target part of a cross-section of the stream transverse to a flow direction of the stream, and the remaining part of the stream in a remaining part of the cross-section of the stream.

With the configuration of the particle concentrating device and the concentrator elements, the invention furthermore allows for a compact assembly, which is beneficial due to the restricted space in drilling subs. The configuration of the particle concentrating device and the concentrator elements furthermore allows for a robust assembly, which is in particular beneficial in handling of abrasive particles, and thus allows for long replacement intervals and reduced maintenance. Also, the invention allows for concentrator elements having a simple design, and a particle concentrating device having a simple configuration, and thus allows for low cost production. Furthermore, because the invention does not require elaborate mechanisms or moving components, the invention allows for an assembly and method that are less susceptible to breakdown and require low maintenance and/or monitoring.

The assembly and the method according to the invention furthermore enable reduced wear of channels through which the stream passes, and/or allow for reduced, e.g. substantially eliminating the consumption of energy required for the concentration and/or enables the extent of the concentration increase to be modulated.

The present invention is in particular envisaged for use with a stream containing abrasive particles, e.g. which are substantially sphere-shaped, cylinder-shaped, e.g. cut from wire, or in the form of grit, and have an effective diameter of approximately 0.8-1.2 mm, e.g. 0.9 or 1 mm, preferably 1 mm. In case of spherical particles, obviously, the effective diameter equals the largest diameter thereof. For example these particles may be made of steel, e.g. ferromagnetic steel. In some applications, ceramic, iron, glass, or aluminum particles may be used as well. In a stream with abrasive particles, the fluid may in particular be drilling liquid. Such streams are in particular suitable for abrasive jet drilling. In other applications, the fluid may e.g. be air, or e.g. be a liquid, e.g. water- or oil based.

The present invention proposes an assembly of a circumferential enclosure and a particle concentration device. The circumferential enclosure is suitable for accommodating a stream of a fluid mixed with particles, for example drilling liquid mixed with abrasive particles. The circumferential enclosure may be a tube, e.g. a tube forming a part of a drill system, e.g. a drill bit or a sub, wherein the sub receives the stream from a drill string and passes the stream into a drill bit.

The stream has a cross-section defined by the circumferential enclosure transverse to a flow direction of the stream. For example in a drilling system, the flow direction may be vertically downwards. In case of directional drilling, at least at a downhole end section of the drilling system the stream may have a horizontal movement component or even move horizontally.

The particle concentration device is arranged inside the circumferential enclosure, and connected thereto. For example, the device may be stationary mounted thereto, or rotatable mounted, e.g. inside a drill bit. In any case, it is connected to enable the stream accommodated by the circumferential enclosure to move relative to the device in order to pass through the device.

The particle concentration device is configured for increasing a concentration of the particles in a target area of the cross-section of the stream. The target area is defined by an outlet of the device, the outlet being arranged at a downstream end of the device, and having a cross-section corresponding to the target area.

According to the invention, the device is arranged inside the circumferential disclosure to discharge the stream within the circumferential disclosure as being composed of a target stream part, which is discharged by the outlet of the device, and a remaining stream part. The arrangement provides that particles of the stream end up in the target portion and in the remaining portion, with respectively a higher and lower concentration than upstream of the device.

It is enabled that the stream continues to flow through the circumferential enclosure downstream of the outlet, however with a different distribution of the concentration of the particles across the cross-section of the stream relative to a cross-section inside the circumferential enclosure upstream of the device. This enables the use of the different stream parts within the circumferential enclosure and within the composed stream.

For example, an actuator within the circumferential enclosure downstream of the device may as enabled by the inventive arrangement by moving across the cross-section alternatingly catch portions of the more concentrated target part and the less concentrated remaining part, to produce in the flow direction pulses within the stream with high and low concentrations of particles. As will be explained later, this may in particular be useful for a modulation of the erosive power of abrasive particles along a repetitive trajectory, e.g. along a circular trajectory of a rotating abrasive jet nozzle impinging a borehole bottom in directional drilling.

In another example, an abrasive jet nozzle downstream of the device may as enabled by the inventive arrangement catch portions of the target part or the remaining part along a trajectory thereof relative to the cross-section, for example a rotation, for modulating the erosive power of the jet discharged by the nozzle.

The device extends around an axis running there through parallel to the flow direction. It comprises an outlet, and a multiple deflectors.

The deflectors and are connected to the outlet of the device. Preferably the deflectors are interconnected within the device—however embodiments wherein the deflectors are interconnected via the circumferential enclosure are also envisaged. The outlet may be connected directly to one or more of the deflectors, for example directly connected to all deflectors, or for example connected directly to one or more of the deflectors and indirectly to one or more others of the deflectors.

The deflectors have the purpose of forming in the flow direction of the stream the target part of the stream. Thereto, the deflectors each have a deflecting surface. The deflecting surfaces are arranged about the axis of the device, and face this axis in different radial directions angularly divided about the axis. The deflecting surfaces slant in the flow direction in a direction from the circumferential enclosure towards the axis, in order to deflect a part of the particles towards the axis, and thus, towards the target area.

The deflecting surfaces extend over respective angular zones of the device with respect to the axis. Each angular zone is defined by side edges of the respective deflecting surface extending over the zone. These side edges preferably extend in an axial plane which comprises the axis—thus, when seen in radial views onto the side edges, these preferably extend along the axis.

According to the invention, the deflecting surfaces together extend over a collective angular zone between the angularly most remote side edges thereof which encloses at least a straight angle, for example an angle of more than approximately 180 degrees, with respect to the axis. Thus, the collective angular zone covers all of the angular zones over which the deflecting surfaces extends. This collective angular zone covers a majority of the angular range around the axis—so as to cover radial directions in a majority of the cross-section.

Thus, the collective angular zone encloses at least a straight angle, e.g. an angle of more than approximately 180 degrees, with respect to the axis.

The effect of the collective angular zone covering radial directions in a majority of the cross-section is that particles are not deflected to one lateral side of the assembly, but, considered all together, inwardly towards the axis. This may provide advantages e.g. in terms of reduced and/or less unilateral wear of the walls of the circumferential enclosure and a more centralized positioning of the target area within the cross-section of the stream as discharged. Furthermore, depending on the shape of the surfaces and the orientation relative to the axis, a particle unduly deflected past the target area by one surface, e.g. deflected relatively far upstream of the outlet, and/or at a relatively sharp deflection angle, has a higher chance of by hitting another surface which covers the direction of its deflection, being deflected still towards the target area by this other surface. Thus, angular zones being divided more widely over the angular range around the axis, increases the probability for particles to hit a surface once or twice, to be deflected to the target area, increasing the concentrating effect of the device.

In operation of the device, the deflecting surfaces together are configured for forming the target part discharged by the outlet of the device. As a result of a part of the particles being deflected towards the target area by the deflectors, the particle concentration is increased in the target area.

The deflecting surfaces define between the side edges thereof one or more bypass openings, which thereby extend over angular zones which are complementary to the zones over which the deflecting surfaces extend. The bypass openings are together configured for e discharging the remaining part of the stream between the circumferential enclosure and the outlet—while the target cross-section is formed radially inwards from any walls of the circumferential enclosure through which the stream flows. It is thus achieved, that the discharged remaining portion forms a layer between the circumferential enclosure and the discharged target portion. The remaining portion having a lower concentration of particles, may advantageously result in the circumferential enclosure being exposed to less particles scouring or impacting the wall as they move there along—potentially causing wear to the circumferential enclosure—and therefore, in reduced wear of the circumferential enclosure.

This is of particular interest when the particles are abrasive particles. This contrary to e.g. the solution of WO2012084934, wherein a high concentration of the particles is directed towards the wall of a channel. Furthermore, the invention provides that deflecting surfaces are arranged divided along the angular range around the axis—so that at the axial location of the device, the deflecting surfaces may form an additional barrier and thus a protection to the circumferential enclosure for the more concentrated part. As a direct result of their function, the deflecting surfaces experience scouring and impacting by the particles. A more durable device may be formed e.g. by choosing a material for the deflecting surfaces that is more resistant thereto—or the device may purposely be designed and formed as a consumable part intended to be replaced regularly.

In an embodiment, respective ones of the deflectors are part of multiple concentrator elements of the device which are successively arranged in the flow direction, e.g. nested inside each other, wherein each concentrator element has one or more of the deflectors.

In another embodiment, the deflectors are all part of a single concentrator element of the device. For example the multiple deflectors of the single concentrator element are interconnected via an outlet element which defines the outlet.

The invention is based on the insight that the particles in the fluid are directable relative to the fluid in a predetermined direction by providing an impulse thereto in this direction. The directing is effective for particles with a Stokes number larger than one, and becomes more effective as the particles exhibit a higher Stokes number. The Stokes number represents to which extent its trajectory is influenced by its inertia rather than the fluid streamlines. For abrasive particles present in a stream for application in abrasive blasting, cutting, jet drilling, and alike, the Stokes number is generally high—which means that their trajectories are dominated by their inertia. For example particles moving in parallel in the flow direction—i.e. axially—can be directed along a trajectory with both an axial and radial component by giving the particles an impulse in a radial direction. As a result, the abrasive particles will continue in this direction, thus moving also radially, relative to the flow direction.

Secondly, the invention is based on the insight that a concentration difference of particles in a stream of a certain cross-section may be created over the cross-section by selectively radially directing a part of the particles towards a target part of this cross-section.

Thirdly, the invention is based on the insight that radially directing the particles towards a target part of the cross-section may be achieved by providing the deflecting surfaces in the stream—which by means of their radial tapering in the flow direction give the mentioned radial impulse to the particles, so that the movement trajectory of the particles impacting any of the deflecting surfaces obtain a radial component.

Fourthly, the invention is based on the insight that providing that the deflecting surfaces together extend around an axis through the target part of the cross-section along the collective angular zone which covers at least a major part of the angular range around the axis, makes the particles overall concentrate towards this axis, rather than just disperse over the cross-section with additional radial components being added to their trajectory. The angular extension of the directing surfaces increases the chance of particles being caught between the deflecting surfaces and moving towards the axis—and therefore, the target cross-section. For example, as explained, a particle that is by an upstream directing surface given a radial movement component such that it moves radially beyond the axis towards a more downstream directing surface may be caught more downstream by another directing surface and be again radially directed towards the axis. Particles already moving radially inside the contour of the target area upon entering the device continue their movement. Particles not moving there between are added thereto by the directing action of the directing surfaces. Thus considering a cross-section of the stream wherein the particles are substantially evenly distributed over the cross-sectional area, moving in the flow direction and entering the device, the net effect of the directing surfaces will be an increase of the particle concentration towards the axis, and thus, in the target cross-section—provided that the Stokes number of the particles is larger than one.

The effectiveness of the invention for a certain stream and target cross-section may be considered in terms of the increase in the particle concentrations of the target stream relative to the initial concentration of the stream. The invention provides that the effectiveness thereof may also be increased by increasing the angular zones over which the deflecting surfaces extend and/or an increasing axial lengths over which the directing surfaces of each axial section extends, and/or increasing the number of deflecting surfaces, e.g. by increasing the number of concentrator elements, and, with a certain limit, increasing the slant angle of the deflecting surfaces relative to the flow direction. Thus, with the invention the concentration increase may be modulated by manipulating the geometry and/or spatial arrangement of the device, e.g. in particular of the parts thereof.

The effectiveness may also increase as a consequence of the properties of the stream, e.g. with an increasing particle size, and increasing Stokes number of the particles.

In an embodiment of the inventive assembly, the outlet of the device is formed by an outlet element, connected directly or indirectly to at least one of the deflecting surfaces at a downstream end thereof. The outlet element has an inner circumference which encloses the target cross-section of the stream. For example, the outlet element is in the form of a cylinder or a short tube, which defines a cylindrical internal space about the axis of a certain axial length. This shape enables the movement directions of the deflected particles to become more synchronized with the flow direction—that is—with a reduced radial movement component. The effect is that a change in the cross-section of the target part of the stream after discharge as the stream continues along the flow direction is reduced. The axial length may be chosen such, that after discharge of the target part, the particles move substantially parallel to the flow direction. The result is that the particles maintain the substantially parallel flow direction after discharge, so that the cross-section of the target part is maintained along the flow direction. The axial length may be adjusted to limit the change in the cross-section after discharge to a desired extent.

In an embodiment, the device comprises an inlet element, connected directly or indirectly to at least one of the deflecting surfaces at an upstream end thereof. The inlet element may have an inner circumference which encloses the cross-section of the stream, for example, substantially equal to or slightly smaller than an inner circumference of the circumferential enclosure. For example, the inlet element is in the form of a ring or cylinder, e.g. slightly conical in the flow direction.

In an embodiment, the device comprises multiple axial sections succeeding one another in the flow direction. The axial sections comprise at least an upstream axial section and a downstream axial section. Along each axial section one or more of the deflecting surfaces extends. Each deflecting surface and each opening extends along at least one respective axial section. Over the downstream axial section, at least one of the deflecting surfaces extends which is distinct from each deflecting surface extending over the upstream axial section, and which extends over an angular zone that is distinct from an angular zone over which a deflecting surface extends. The effect of the angularly distinct deflecting surfaces is that the particles along different angular zones are given direction towards the target area in different axial sections, which may result in savings in the use of material. For example, a deflecting surface of an upstream axial section not extending over a downstream axial section may be sufficient to give direction to the particles in order for them to continue, as a result of the Stokes effect, along the same slanted path towards the target area. The extension of this deflecting surface over the downstream axial section may thus be omitted, while the axial distance between the deflecting surface and the outlet may be still necessary in order for them to have move far enough inwards to end up radially within the contour of the target area at the outlet. This saves material for the deflector along the downstream axial section.

In an embodiment, the device comprises for each axial section a respective concentrator element, of which the respective deflectors have the deflecting surfaces extending over each respective axial section. Thus, an upstream concentrator element is provided for the upstream axial section, and a downstream concentrator element for the downstream axial section. The upstream concentrator element has the deflectors of which the deflecting surfaces extend over the upstream axial section, and the downstream element has the deflectors of which the deflecting surfaces extend over the downstream axial section. The deflectors of the upstream concentrator elements may also extend over the downstream axial section, in particular when it is nested therein.

Providing multiple concentrator elements enables that the axial length of the device is adjustable, e.g. and the lengths of the axial sections thereof, when present—respectively by inserting the downstream parts of the concentrator elements further or less far into respective successive ones. Inserting a concentrator element further into the successive one, e.g. by placing an axially shorter spacer element therebetween, when present, decreases the axial length by which the upstream part of the concentrator element protrudes from the successive one, and thereby the axial length of the axial section formed by the protruding upstream part. Thereby, the axial length of the part of the deflecting surfaces and openings of the protruding axial section is adjustable. Thereby, the effectiveness of the device can be modulated.

The number of axial sections of the device is adjustable by providing more or less concentrator elements—which in turn may again be used for modulation of the effectiveness of the device. After all, providing more concentrator elements to become part of the device may increase the total of the axial lengths of the deflecting surfaces and bypass openings of the device. For example, for increased effectiveness, one or more concentrator elements, e.g. one, may be added in precession or succession to already present concentrator elements, e.g. by inserting the one or more body elements into the most upstream one already present.

Furthermore, this embodiment enables to modulate the effectiveness by adjusting the angular arrangement of the concentrator elements relative to one another. Thereto, one or more of the concentrator elements may be angularly displaced with respect to one or more others of the concentrator elements such that the angular range around the axis over which the angular zones over which the deflecting surfaces of the concentrator elements together extend is decreased or increased. Thereby, the effectiveness of the device may be modulated. The deflecting surfaces of the at least one of the axial sections are angularly movable along with one another, as these have the concentrator elements. The angular displacing may e.g. be done prior to or after axial arrangement of concentrator body element relative to already present concentrator elements for becoming part of the device, e.g. while already arranged axially into the device.

Another embodiment without multiple angularly movable concentrator elements is envisaged wherein the deflecting surfaces extending over at least one of the axial sections are angularly movable relative to the deflecting surfaces of at least one other of the axial sections, e.g. for the purpose of modulating the effectiveness of the device, for example by providing them movable inside the respective concentrator element.

In an embodiment, the device may further comprise one or more actuators, e.g. one or more motors, e.g. a step motor, which is operative between the deflecting surfaces, e.g. between the axial sections, e.g. between the concentrator elements which are angularly movable relative to one another, for angularly displacing the associated directing surfaces relative to one another.

In an embodiment, the concentrator elements of the device are nested, e.g. stacked, along the axis. A most upstream one of the concentrator elements is with a downstream axial part thereof inserted into a downstream one of the concentrator elements, such that an upstream axial part of the upstream concentrator element protrudes from the downstream concentrator element. In case the axial sections are present, the upstream axial part of the upstream concentrator element forms the upstream axial section. In an example, the downstream axial part of the upstream concentrator element is arranged concentrically inside the upstream axial part of the downstream concentrator element.

With its downstream axial part being inserted into the successive concentrator element, only the upstream part of the most upstream one of the separate body elements forms the most upstream one of the axial sections. Similarly, the most downstream one of the axial sections is formed by at least the most downstream one of the concentrator elements, and the downstream axial part of the preceding one of the concentrator element. If present, intermediate ones of the axial sections are each formed by at least the upstream axial part of the respective intermediate one of the concentrator elements, and the downstream axial part of the preceding one of the concentrator elements.

In an embodiment, the deflecting surfaces together extend over at least a majority of the angular range around the axis. Id est, the angles defined by the angular zones relative to the axis are, when summed up, larger than 180 degrees. An enhanced concentrating effect of the device may result. It is noted that a larger surface area of the deflecting surfaces, as well as a more aggressive angle towards to the axis, may result in a larger pressure drop over the device—along with a larger drop in the particle velocity. On the other hand, the concentrating effect may increase. Amongst others depending on the properties of the stream, e.g. its dynamic properties, e.g. density, viscosity, drag, velocity profiles, and e.g. particle size and concentration, and cross-sectional dimensions, and on the desired extent of concentration, the deflecting surfaces may be suitably dimensioned to fit the intended purpose.

The deflecting surfaces are preferably curved, e.g. so as to each form angular segments of one or more virtual cones. For example, so that the deflecting surfaces of each concentrator element form angular segments of a cone. The deflecting surfaces may e.g. also be straight, e.g. so as to form angular segments of a frustum, e.g. for each concentrator element.

The bypass openings each have size which enables the particles to pass through the openings. In an assembly for use with a particles with a certain size, this size is the lower limit of the size of the bypass openings. For example, the size of each opening is such that at least three particles, e.g. at least five particles, can pass through the opening at the same time. For example, a diameter of the opening is larger than a largest diameter of the particles. For example, the opening has no dimension smaller than a largest diameter of the particles, for example no dimension smaller than three times an effective diameter of the particles, for example no dimension smaller than five times a largest diameter of the particles, for example no dimension smaller than five times an effective diameter of the particles, for example no dimension smaller than five times a largest diameter of the particles. In an example case of abrasive particles, wherein the particles are substantially spherical, and the particles have an effective diameter of approximately 0.8-1.2 mm, e.g. 0.9 or 1 mm, preferably 1 mm, a smallest diameter of the openings is preferably at least approximately 2-4 mm, preferably at least around 3 mm, for example at least approximately 4-6 mm, preferably at least around 5 mm. In an example, for example, e.g. in case of four-sided openings, the effective diameter of each opening is at least approximately 2-4 mm, preferably at least around 3 mm, for example at least approximately 4-6 mm, preferably at least around 5 mm.

In an embodiment the size of the bypass openings is at least the size of the target area as defined by the outlet, so that the bypass openings are able to discharge larger solids within the remaining portion than the outlet within the target portion of the stream. For example, in drilling operations wherein the fluid of the stream is drilling liquid, and the particles are abrasive particles, wherein the stream may additionally contain debris and mud parts from the borehole. As discussed the bypass openings, and to a larger extent with a larger size thereof, contribute to the structure of the device being open, and may reduce or prevent these parts from adhering to the interior of the device, and/or accumulating inside the device—and thereby to a self-cleaning property of the device during operation.

The invention thus enables the particles to pass the openings—e.g. enables the particles not concentrated to be discharged in the remaining part of the stream, and enables already discharged particles to re-enter the body to be discharged in the target part of the stream—for example, discharged particles deflected back into the openings by hitting the circumferential enclosure or another particle within the stream.

Increasing the size, e.g. the smallest diameter, of the openings decreases the risk of the openings becoming clogged by the particles. The effectiveness of the clogging risk decrease with a constant particle velocity and concentration is higher as the opening sizes are increased. Increased opening sizes may be desired with higher concentrations of particles within the stream to be passed through the device, and higher particle velocities. However, with increasing opening sizes the effectiveness of the particle concentration, in terms of the achieved concentration difference between the target part and the remaining part of the stream, may be decreased.

The above discussion for the openings also applies to a spacing between the deflectors of different concentrator elements, when nested. The spacing must be large enough to pass particles and prevent clogging thereof between the concentrator elements. Preferably, no spacing is smaller than the particle diameter, e.g. any spacing being at least three times, e.g. at least five times, the particle size.

In an example, the device preferably further comprises one or more spacer elements which axially interconnects the different concentrator elements, and therewith the deflectors, at a mutual axial distance. For example, the spacer element interconnects axially adjacent concentrator elements by abutting these at axial ends thereof. For example, the spacer element is in the form of a short tube, placed between circumferential flanges at upstream ends of the axially adjacent concentrator elements to hold these at an axial distance.

In an embodiment, the deflecting surfaces each extend radially from the circumference of the circumferential enclosure, i.e. corresponding to an inner circumference of an inlet element of the device, if present, and the circumference of the target cross-section of the stream, i.e. corresponding to the inner circumference of the outlet of the device. For example, the deflecting surfaces extend, radially, from the inlet element to the outlet element, when present. For example, in case of multiple concentrator elements, the deflecting surfaces of the most upstream concentrator element are directly connected to the inlet element, when present, and the deflecting surfaces of the most downstream concentrator element are directly connected to the outlet element, when present. The deflecting surfaces of the most upstream concentrator element may be directly connected to an intermediate tube element upstream of the outlet element in the extension thereof, for example with the same dimensions as the outlet element. The effect is that the particles already deflected by the upstream concentrator element radially within the target area may be kept radially within the target area, and synchronized with the flow direction prior to entering the target area and the outlet element.

In an embodiment, the deflecting surfaces and openings of the device together enclose in between them a space which is substantially in the shape of a frustum, e.g. a right frustum, preferably a conical frustum, e.g. a right conical frustum. Preferably, the base of the frustum is defined by the circumferential enclosure upstream of the device, or by an inlet, and the top by the outlet. Thus in case the target area of is concentric with the circumferential enclosure or the inlet, the deflecting surfaces and openings together enclose between them substantially the shape of a right frustum, e.g. a right conical frustum. Thus, the deflecting surfaces may be conically arranged around the axis.

In an embodiment with multiple concentrator elements, the number of deflecting surfaces in each concentrator element is exactly one. In other embodiments with multiple concentrator elements, the number of deflecting surfaces in each concentrator element is two, three, four, or five, preferably exactly two or four. In an embodiment, the number of concentrator elements is exactly two, or three. In an embodiment with one single concentrator element, the number of axial sections is exactly two, three, or four.

In a first example, the number of concentrator elements is exactly two, and the number of deflecting surfaces in both concentrator elements is exactly one. In a second example, the number of concentrator elements is exactly three, and the number of deflecting surfaces in each concentrator element is exactly one. In the first and second example the angle of the respective angular zone of the directing surface may for example be between 100 and 350 degrees, e.g. between 120 and 240 degrees, e.g. between 140 and 200 degrees, e.g. approximately 180 degrees. In the second example, the angle of the respective angular zone of the deflecting surface may for example also be between 65 and 350 degrees, e.g. between 80 and 160 degrees, e.g. between 90 and 130 degrees, e.g. approximately 120 degrees. In a third example, the number of concentrator elements is exactly one, and the number of deflecting surfaces in each concentrator element is exactly four. In a fourth example, the number of concentrator elements is exactly two, and the number of deflecting surfaces in each concentrator element is exactly four. In the third and fourth example the angle of the respective angular zone of the deflecting surfaces may for example be between 10 and 350 degrees, e.g. between 10 and 60 degrees, e.g. between 15 and 50 degrees, e.g. approximately 45 degrees. In the fourth example the angle of the respective angular zones of the deflecting surfaces may for example also be between 10 and 350 degrees, e.g. between 10 and 45 degrees, e.g. between 15 and 40 degrees, e.g. approximately 35 degrees.

In embodiments with multiple concentrator elements, the concentrator elements are radially arranged with respect to one another such that the deflecting surfaces of an upstream concentrator element is at least partially radially offset, for example radially spaced, from the deflecting surfaces of a downstream concentrator element.

Preferably the deflecting surfaces of each concentrator element define together with the openings thereof in between them a space in the form of a frustum, e.g. a right frustum, e.g. a conical frustum, e.g. a right conical frustum, so that when arranged in axial succession, the deflecting surfaces and openings of the whole device enclose such frustum, as discussed before.

In an embodiment, the concentrator elements, if provided in plural, are geometrically substantially equal to one another. This may be to the advantage of the manufacturability of the device and a simple and predictable modularity thereof in terms of the expected effect on the effectiveness of adjusting the number of concentrator elements of the device.

In an embodiment, the target area is within a center portion of the cross-section of the stream, so that the target portion of the stream as discharged by the device is encircled by the remaining portion, e.g. the target portion having a circular cross-section and the remaining portion having an annular cross-section.

The invention furthermore relates to a particle concentration device as described herein for use in an assembly or method according to the invention as described herein.

The invention furthermore relates to a concentrator element according to the invention for use in an assembly, a device or method according to the invention as described herein.

The invention relates to a method for increasing a concentration of particles in a stream of a fluid mixed with the particles in a target part of a cross-section of the stream transverse to a flow direction of the stream, wherein use is made of the particle concentration device as described herein.

The method according to the invention for increasing a concentration of particles in a stream of a fluid mixed with the particles in a target part of a cross-section of the stream transverse to a flow direction of the stream, which comprises the following steps.

1) providing the stream of the fluid mixed with the particles,
2) providing deflecting surfaces and arranging the deflecting surfaces in the stream, such that the deflecting surfaces:
   extend over respective angular zones with respect to an axis through the target area of the stream cross-section, e.g. such as all extend within a collective angular zone which is angularly bounded by the deflecting surfaces (31.1, 31.2, 31.3) and which covers a majority of the angular range around the axis,
   slant in the flow direction in a direction from the circumference of the stream towards the target area, and
   define radially in between them multiple bypass openings which extend over angular zones complementary to the angular zones over which the deflecting surfaces extend, and each having a smallest diameter which is larger than an effective diameter, e.g. larger than a largest diameter, of the particles, e.g. at least approximately three times an effective diameter of the particles, e.g. at least approximately five times the effective diameter,
3) directing, by means of the deflecting surfaces at least a part of the particles inwardly towards the axis,
4) discharging a target part of the stream with the target area around the axis, and
   discharging, through the bypass openings, a remaining part of the stream between the target part and the circumference of the stream, such as to discharge the stream as composed of the target part and the remaining part.

In an embodiment, use is made of the particle concentrating device as described herein, and step 2) of the method comprises providing the device and arranging the device in the stream.

In an embodiment, the deflecting surfaces succeed one another in the flow direction of the stream, in succeeding axial sections.

The advantages and effects described above in relation the device according to the invention, even as the insights on which the invention is based, are equally applicable to the methods according to the invention.

In an embodiment, use is made of the particle concentrating device as described herein which comprises the separate concentrator elements. This embodiment may comprise prior to step 3) the further step of assembling the device. The assembling comprises:

arranging two or more concentrator elements successively, e.g. by stacking, along the axis in the flow direction, such that respective axial sections are formed by at least a part of at least the respective concentrator elements, and angularly arranging the concentrator elements with respect to one another such that the deflecting surfaces are at least partially angularly offset from one another to together extend over the collective angular zone which covers at least a majority of the angular range around the axis.

The invention furthermore relates to a method of assembling a particle concentration device according to the invention, comprising the above arranging steps.

An embodiment comprises the further step of modulating the extent of the increase of the concentration of the particles in the target part of the cross-section of the stream, i.e. modulating the effectiveness. The modulating comprises:

arranging one or more body elements according to the invention along the axis in precession or succession to the two or more body elements of the device, e.g. such that a precessive or successive axial section of the device is formed by at least part of at least the arranged one or more body elements, and/or angularly moving one or more of the body elements with respect to one or more others of the body elements such as to decrease the angular range around the axis over which the angular zones over which the directing surfaces of the body elements together extend.

In an embodiment the fluid is a drilling fluid and the particles are abrasive particles for abrasive jet drilling, e.g. with an effective diameter of 0.8-1.2 mm, e.g. 0.9 or 1 mm, preferably 1 mm. The effective and/or largest diameter of the particles limits the size of the openings as herein described. The particles may in particular be substantially sphere-shaped. Therein the particles, e.g. abrasive particles, may have an effective diameter, substantially equal to their largest diameter, e.g. of approximately 0.8-1.2 mm, e.g. 0.9 or 1 mm, preferably 1 mm. Alternatively, the abrasive particles may be cylinder-shaped.

The invention furthermore relates to a method for directional drilling comprising the method as described, and comprising the further step of varying the extent of erosion of a borehole bottom along azimuthal positions thereof. This varying comprises selectively directing the target part into impingement with the borehole bottom at a determined range of the azimuthal positions in the form of an abrasive jet.

For example in a drill bit, this selective direction of the target part may involve selectively directing, in dependence of an azimuthal position of one or more abrasive jet nozzles of the drill bit which move along the azimuthal positions of the borehole bottom, at least the target part of the stream towards one or more of the nozzles. In one example, this is done by stationarily directing the target part of the stream towards the determined azimuthal range and aligning the nozzle with the directed target part only when the nozzle(s) are within the determined azimuthal range. In another example, this is done by moving the target part along with the nozzle along the azimuthal positions of the borehole bottom and directing the target part into the nozzle, e.g. by alignment therewith, only when the nozzle(s) are within the determined azimuthal range.

The invention furthermore relates to the use of the device according to the invention in a system or method for abrasive jet drilling, e.g. the method for directional drilling according to the invention, wherein the fluid is a drilling fluid and the particles are abrasive particles for abrasive jet drilling, e.g. with an effective diameter of approximately 0.8-1.2 mm, e.g. 0.9 or 1 mm, preferably 1 mm, e.g. substantially sphere-shaped.

In an embodiment of the use, the device is used in a sub of an abrasive jet drilling system, the sub forming the circumferential enclosure and being connected at a downhole end thereof to a drill bit of the system, e.g. so as to be rotatable along therewith, and at another end thereof to a tubular drill string of the system. Therein the assembly receives the stream of drilling fluid and abrasive particles from the drill string and the target part of the stream discharged by the outlet of the device is directed into one or more abrasive jet nozzles of the drill bit. For example, the target part is directed into these nozzle(s) in dependence of an azimuthal position of the nozzle(s) such as to vary the extent of erosion of a borehole bottom along azimuthal positions thereof.

In an embodiment, the device is used in a drill bit of an abrasive jet drilling system, the drill bit forming the circumferential enclosure and being connected to a lower end of a drill string, wherein the assembly receives the stream of drilling fluid and abrasive particles from the drill string, e.g. from a sub, and the target part of the stream discharged by the outlet of the device is directed into one or more abrasive jet nozzles of the drill bit, e.g. in dependence of an azimuthal position of the nozzle such as to vary the extent of erosion of a borehole bottom along azimuthal positions thereof.

The invention furthermore relates to a sub for use in an abrasive jet drilling system, e.g. a directional drilling system, connected at a downhole end thereof to a drill bit of the system, e.g. so as to be rotatable along therewith, and at another end thereof to a tubular drill string of the system from which the sub receives the stream of fluid and particles, the fluid being drilling fluid and the particles being abrasive particles, wherein the sub comprises the device according to the invention. Therein the device is arranged in the sub such that the stream of drilling fluid and abrasive particles is passed through the device, and the target part of the stream as discharged by the outlet of the device is directed or directable into the drill bit.

The invention furthermore relates to an assembly of a sub and a particle concentration device as described herein.

The invention furthermore relates to a drill bit for use in an abrasive jet drilling system, connected or connectable to a lower end of a drill string, e.g. to a sub, from which the drill bit receives the stream of fluid and particles, the fluid being drilling fluid and the particles being abrasive particles, wherein the drill bit comprises the device according to the invention.

Therein the device is arranged in the drill bit such that the stream of drilling fluid and abrasive particles received from the drill string, e.g. from a sub, is passed through the device, and the target part of the stream discharged by the outlet of the device is directed or directable into one or more abrasive jet nozzles of the drill bit.

The invention furthermore relates to an assembly of a drill bit and a particle concentration device as described herein.

The invention furthermore relates to assembly, preferably a drilling assembly comprising a sub and a particle concentration device, the assembly comprising:

a circumferential enclosure, e.g. a tube, for accommodating a stream of a fluid mixed with particles, e.g. the fluid being a drilling liquid, and the particles being abrasive particles, e.g. a steel shot, the stream having a cross-section defined by the circumferential enclosure transverse to a flow direction of the stream, and a particle concentrating device that extends around an axis parallel to the flow direction, and is arranged inside the circumferential enclosure, the particle concentrating device comprising:

multiple concentrator elements that are successively arranged in the flow direction, e.g. partially nested inside each other, each concentrator element having one or more of the deflectors, or a single concentrator element having multiple deflectors, wherein the particle concentration device is configured for increasing a concentration of the particles in a target area of the cross-section of the stream, and for discharging, within the circumferential enclosure, the stream as being composed of a target part, with the increased concentration of particles, and a remaining part encircling the target part, wherein the multiple deflectors each have a deflecting surface, and wherein the deflecting surfaces:

are arranged about the axis, slanting in the flow direction from the circumferential enclosure towards the axis, for deflecting a part of the particles towards the axis, and thus towards the target area, extend over respective angular zones of the device with respect to the axis, the angular zones each being defined by side edges of the respective deflecting surface, define between the side edges thereof one or more bypass openings which thereby extend over angular zones complementary to the angular zones over which the deflecting surfaces extend, and preferably, when combined, together extend over a collective angular zone between the angularly most remote side edges thereof, which angular zone covers a majority of the angular range around the axis, e.g. covers at least 180 degrees of the angular range of 360 degrees, wherein, in operation of the device, the deflecting surfaces together form the target part, and the bypass openings together form the remaining part of the stream.

The invention furthermore relates to a directional drilling system for directional drilling of a borehole with a borehole bottom in an object, e.g. an earth formation, e.g. a subterranean earth formation, connectable to a tubular drill string, the directional drilling system comprising:

a drill bit, comprising:

a bit face, which during use faces the borehole bottom, a bit fluid inlet port, one or more abrasive jet nozzles configured for ejecting a stream of drilling fluid mixed with abrasive particles into impingement with the borehole bottom in the form of an abrasive jet, which one or more abrasive jet nozzles, if in plural, are arranged at different azimuthal positions, and an intermediate space between the bit fluid inlet port and said one or more abrasive jet nozzles, each of the one or more abrasive jet nozzles having a nozzle inlet for fluid communication with the intermediate space, from which each of the nozzle inlets extends; and a sub, connected or connectable at a downhole end thereof to the drill bit, e.g. so as to be rotatable along therewith, and at another end thereof to the tubular drill string, the sub comprising:

a sub fluid inlet port, fluidly connectable to a supply channel through the drill string to receive from said supply channel a stream of drilling fluid mixed with abrasive particles when the system is connected to the drill string, and a sub fluid outlet port, fluidly connected or connectable to the bit fluid inlet port, wherein the sub further comprises, fluidly connected to the sub bit inlet port, downstream thereof, a modulation unit configured to cause a variation of a concentration of abrasive particles along stream portions of the stream received from the supply channel that are subsequently passed through the sub bit fluid outlet port into the bit fluid inlet port, the modulation unit comprising:

a first channel having a first flow resistance to the drilling fluid mixed with abrasive particles, a first inlet, and a first outlet fluidly connected to the sub bit fluid outlet port, a second channel arranged in parallel to the first channel, having a second flow resistance to the drilling fluid mixed with abrasive particles, a second inlet, and a second outlet fluidly connected to the sub bit fluid outlet port, a particle deflection device between the sub bit fluid inlet port and the first and second inlets, comprising one or more actuators, and being connected to a control unit of the system, wherein the particle deflection device comprises an assembly according to the invention upstream of the first and second inlet, and wherein the first inlet has a cross section similar to the target area of the cross section of the stream and the second inlet extends around the first inlet for, when the first inlet is aligned with the axis of the assembly for receiving the target part of the stream, receiving the remaining part of the stream, and wherein the particle deflection device is configured to periodically, preferably based on control signals received from the control unit, during a first time period, support the first inlet in line with the axis of the assembly to guide the target part of the stream into the first inlet and guide the remaining part of the stream into the second inlet, and thus during the first time period deflect into the first inlet a majority of all abrasive particles received from the supply channel through the sub bit fluid inlet port, and during a second time period following the first time period, support the first inlet away from the axis of the assembly to guide part of the reaming part of the stream into the first inlet, while guiding the other part of the remaining part of the stream and the target part of the stream into the second inlet, and thus during a second time period following the first time period, not deflect into the first inlet a majority of all abrasive particles in the stream received from the supply channel through the sub bit fluid inlet port, wherein the first and second channel are embodied such that a difference between the first flow resistance and the second flow resistance results in a velocity difference between said drilling fluid mixed with abrasive particles passing through said first channel and said drilling fluid mixed with abrasive particles passing through said second channel, wherein said velocity difference is such that in a combination section downstream of the first and second outlets, the majority deflected into the first channel during the first time period and the abrasive particles passed into the second channel during the second time period, together with any of said drilling fluid passed into the first and second channel during the first and second time period, respectively, are combined into one of said stream portions, and abrasive particles passed into the first channel during the second time period and the abrasive particles passed into the second channel during a first time period following the second time period, together with any drilling fluid passed into the first channel during the second time period and into the second channel during the first time period following the second time period, respectively, into a subsequent one of said stream portions.

The invention furthermore relates to a method for concentrating particles in a circumferentially enclosed stream of a fluid mixed with the particles, in a target area of a cross-section of the stream transverse to a flow direction of the stream, wherein use is made of the assembly according to the invention.

The invention furthermore relates to a method for concentrating particles in a circumferentially enclosed stream of a fluid mixed with the particles, in a target area of a cross-section of the stream transverse to a flow direction of the stream, wherein use is made of an assembly, preferably an assembly according to the invention, the assembly comprising:

- deflecting surfaces that are arranged such that the deflecting surfaces:
  - extend over respective angular zones with respect to an axis through the target area of the stream cross-section, e.g. such as to all extend within a collective angular zone which is angularly bounded by the deflecting surfaces and which covers a majority of the angular range around the axis,
  - slant in the flow direction in a direction from the circumference of the stream towards the target area, and
  - define angularly in between them multiple bypass openings, which extend over angular zones complementary to the angular zones over which the deflecting surfaces extend, and which each have a smallest diameter which is larger than an effective diameter, e.g. larger than a largest diameter, of the particles, e.g. at least approximately three times an effective diameter of the particles, e.g. at least approximately five times the effective diameter, the method comprising the steps of:

- providing the stream of the fluid mixed with the particles,
- deflecting, by means of the deflecting surfaces at least a part of the particles inwardly towards the axis,
- discharging a target part of the stream with the target cross-section around the axis, and discharging, through the openings, a remaining part of the stream between the target part and the circumference of the stream, such as to discharge the stream as composed of the target part and the remaining part, The invention furthermore relates to a further method, wherein use is made of a particle concentrating device that comprises the multiple concentrator elements, wherein the concentrator elements are arranged successively, e.g. by stacking, in the flow direction, and wherein the concentrator elements are angularly arranged with respect to one another such that the deflecting surfaces are at least partially angularly offset from one another to together extend over the collective angular zone covering at least a majority of the angular range around the axis.

The invention furthermore relates to a further method, the method comprising the further step of modulating the extent of the increase of the concentration of the particles in the target area of the cross-section of the stream, wherein the one or more concentrator elements are arranged along the flow direction in precession or succession to the two or more concentrator elements of the device The invention furthermore relates to a method comprising the further step of modulating the extent of the increase of the concentration of the particles in the target area of the cross-section of the stream, the method comprising:

- angularly moving one or more of the concentrator elements with respect to one or more others of the concentrator elements such as to increase or decrease the total angular range around the axis over which the angular zones over which the deflecting surfaces of the concentrator elements together extend.

The invention furthermore relates to a further method wherein the fluid is a drilling fluid and the particles are abrasive particles for abrasive jet drilling, e.g. with an effective diameter of 0.8-1.2 mm, e.g. 0.9 or 1 mm, preferably 1 mm.

The invention furthermore relates to a method comprising the further step of varying the extent of erosion of a borehole bottom along azimuthal positions thereof, comprising selectively directing the target part of the stream into impingement with the borehole bottom at a determined range of the azimuthal positions in the form of an abrasive jet.

The invention furthermore relates to the use of the assembly according to the invention for abrasive jet drilling, wherein the fluid is a drilling fluid and the particles are abrasive particles for abrasive jet drilling, e.g. with an effective diameter of approximately 0.8-1.2 mm, e.g. 0.9 or 1 mm, preferably 1 mm.

The invention furthermore relates to a use wherein the assembly according to the invention is used in a sub of an abrasive jet drilling system, wherein the assembly receives the stream of drilling fluid and abrasive particles from the drill string.

Advantageous embodiments of the assembly according to the invention and the method according to the invention are disclosed in the sub claims and in the description, in which the invention is further illustrated and elucidated on the basis of a number of exemplary embodiments, of which some are shown in the schematic drawing.

It will be appreciated by the skilled person that a technical feature discussed herein as required or as optional with respect to one embodiment of the invention may be equally applicable to one or more other embodiments described herein, with the feature performing its designation function. Such combinations are all envisaged herein unless a combination would result in a technical impossible solution and/or not meet the desired functionality.

BRIEF DESCRIPTION OF THE DRAWINGS

In the drawings:

FIGS. 1*a-k* illustrate schematically a first and a second embodiment of a device according to the invention, and a first embodiment of a concentrator element according to the invention;

FIGS. 2*a-f* illustrate schematically a third embodiment of a device according to the invention, and a second embodiment of a concentrator element according to the invention;

FIGS. 3*a-d* illustrate schematically a third embodiment of the invention;

FIGS. 4*a-c* illustrate schematically the second embodiment of the invention while increasing a concentration of particles in a stream;

FIGS. 5*a-d* illustrate schematically a device according to the invention while being used in a sub of an abrasive jet drilling system; and FIGS. 6*a-f* illustrate schematically a device according to the invention while being used in a sub and a drill bit of an abrasive jet drilling system.

DETAILED DESCRIPTION OF EMBODIMENTS

FIG. 1*d* illustrates schematically a front and top view of a first embodiment of a particle concentrating device 1 according to the invention. The first embodiment is furthermore illustrated in FIGS. 1*f-i*. In FIGS. 4*a-c* the first embodiment is shown while increasing a concentration of particles 92 in a stream 90 of a fluid 91 mixed with the particles 92 in a target area 90*ct* of a cross-section 90*c* of the stream 90 transverse to a flow direction 90*f* of the stream 90. The shown embodiments are suitable for use with a stream 90 wherein the particles 92 are sphere-shaped abrasive particles 92 with an effective diameter of approximately 1 mm, and the fluid is drilling fluid 91, as is the case in FIGS. 4*a-c*. In these figures six example particles 92 are illustrated of which the size is exaggerated, for illustrating possible flow trajectories thereof while passing the device 1. FIG. 4*a* is a partial front view with a partial cross-section of the stream 90 through a channel, and FIGS. 4*b,c* are top views of the cross-sections C-C and D-D indicated throughout the figures.

As shown most clearly for the respective embodiments in FIGS. 1*a,d,e*, FIGS. 2*a,d*, FIG. 3*a*, the device 1 according to either embodiment of the device 1 has an axis 1*a* running there through in a plane of the flow direction 90*f*.

The device 1 according to either embodiment comprises an inlet element 10 defining an inlet to the device, an outlet element 20 defining an outlet of the device, and a body 30. The inlet element 10 is arranged around the axis 1*a* for receiving the stream 90, and has an inner cross-section 10*c* approximately equal to the cross-section 90*c* of the stream. Its inner diameter 10*di* is approximately 44 mm and its outer diameter 10*do* is approximately 50 mm. Its axial length 10*h* is approximately 5 mm. The outlet element 20 is arranged around the central axis 1*a* downstream of the inlet element 10 and has an inner cross-section 20*c* equal to the target cross-sectional part 90*ct*, for discharging a target part 90*t* of the stream 90. The inner diameter 20*di* of the outlet is approximately 16 mm and its axial length 20*h* is approximately 13 mm.

The body 30 interconnects the inlet element 10 and the outlet element 20, for forming in the flow direction 90*f* the target part 90*t* of the stream 90 while discharging a remaining part 90*r* of the stream. In the fourth embodiment the axial length 30*h* of the body 30 is approximately 55 mm.

In the first, second and third embodiment, the body 30 is made out of separate concentrator elements 1.1, 1.2, 1.3 in the manner shown in FIGS. 1*c* and 2*c* and discussed in more detail later. In these embodiments the axial length of the body 30 is determined by the length 1.1*bh* of separate concentrator elements 1.1, 1.2, 1.3, which is approximately 60 mm, the axial length 40*h* of spacer element 40, which is approximately 13 mm, the axial length 1.1*h* of the element inlets 1.1*i*, which is approximately 5 mm, and the number of concentrator elements 1.1, 1.2, 1.3 of the device 1—i.e. two in case of the first and third embodiment and three in the case of the second embodiment.

The body 30 of the device 1 has multiple axial sections 30.1, 30.2, 30.3. The first and fourth embodiment have exactly two axial sections 30.1, 30.2. The second and third embodiment have exactly three axial sections 30.1, 30.2, 30.3.

As shown in FIG. 4*a* for the first embodiment of the device, which has two axial sections 30.1, 30.2, the axial sections 30.1, 30.2 succeed one another in the flow direction 90*f*. As can be verified from FIGS. 1*e*, 2*a,d* and 3*a* is also the case for the second, third and fourth embodiment.

The device according to either embodiment comprises multiple deflectors with respective deflecting surfaces 31.1, 31.2, 31.3. Each axial section 30.1, 30.2, 30.3 has one or more deflecting surfaces 31.1, 31.2, 31.3 extending thereover. The axial sections 30.1, 30.2 of the first and fourth embodiment each have exactly one respective deflecting surface 31.1, 31.2. The axial sections 30.1, 30.2, 30.3 of the second embodiment also each have exactly one respective deflecting surface 31.1, 31.2, 31.3 extending thereover. In the third embodiment, the axial sections 30.1, 30.2, 30.3 each have exactly four respective deflecting surfaces 31.1, 31.2, 31.3 extending thereover.

As shown best in the top views in the figures, the deflecting surfaces 31.1, 31.2, 31.3 of each axial section each extend over respective angular zones 30α1, 30α2, 30α3 of the body 30 with respect to the axis 1*a*. The angular zones are defined by edges 31.1*e*, 31.2*e*, 31.3*e* of the deflecting surfaces, which are indicated for the first and second embodiment in FIGS. 1*d,e*, respectively. The edges 31.1*e*, 31.2*e*, 31.3*e* extend in a plane of the axis 1*a*.

In each embodiment the deflecting surfaces 31.1, 31.2, 31.3 each slant towards the axis 1*a* in the flow direction 90*f* for deflecting a part of the particles 92 towards the axis. The deflecting surfaces 31.1, 31.2, 31.3 each define between the edges 31.1*e*, 31.2*e*, 31.3*e* thereof one or more bypass openings 32.1, 32.2, 32.3 which thereby extend over angular zones 30β1, 30β2, 30β3 complementary to the angular zones 30α1, 30α2, 30α3 over which the deflecting surfaces extend. The angular zones are illustrated in the schematic top views of the cross-sections C-C and D-D for the shown embodiments. In some of the figures, the bypass openings of the device are indicated by a dotted shading with low density—with the mere purpose of clarifying their locations and extension.

As can be verified from the figures, the deflecting surfaces 31.1, 31.2, 31.3 define together with the bypass openings 32.1, 32.2, 32.3 a space there between which is in the form of a frustum, namely a conical frustum.

The deflecting surfaces 31.1, 31.2, 31.3 are in each embodiment together configured for the forming of the target part 90*t* of the stream 90 and together extend over a collective angular range defined by the angularly most remote edges 31.1*e*, 31.2*e*, 31.3*e* relative to the axis 1*a* which covers the majority of the angular range around the axis 1*a*. See for example the top views of the cross-sections C-C and D-D in FIGS. 1*g*, 2*f*, and 3*c*. For example, in the embodiment of FIG. 1*d*, the angular range of the deflecting surface 31.1

The bypass openings 32.1, 32.2, 32.3 are together configured for the discharging of the remaining part 90*r*. The bypass openings 31.1, 31.2, 31.3 each have a smallest diameter 32.1*d*, 32.2*d*, 32.3*d* of at least approximately five times the diameter of the particles of the stream for which the concentrating device 1 is suited.

In the first, second, and fourth embodiment this smallest diameter is approximately 16 mm, substantially corresponding to the inner diameter 20*di* of the outlet element 20. In the third embodiment the smallest diameter is approximately 10 mm.

It is noted that the dimensions mentioned in relation to the shown embodiments form merely one option out of a large range of possibilities for the intended particle size of these embodiments. Furthermore, for other particle sizes and fluids, the device may be scaled accordingly in order to obtain the same or a similar concentrating effect. For the same or other particle sizes and fluids, dimensioning and spatial arrangement may be adapted to either enhance or reduce the concentrating effect of the device 1 towards the target section 90*t* of the stream 90 as desired.

In the fourth embodiment, the body 30 of the device 1 is unitary—i.e. is made out of one piece.

In the first, second and third embodiment, the body 30 of the device 1 comprises for each axial section 30.1, 30.2, 30.3 a respective separate hollow open-ended concentrator element 1.1, 1.2, 1.3. Each respective concentrator element 1.1, 1.2, 1.3 comprises the deflectors having the deflecting surfaces 31.1, 31.2, 31.3 and bypass openings 32.1, 32.2, 32.3 of the respective axial section 30.1, 30.2, 30.3.

For the first and second embodiment, FIGS. 1*a,b* show, respectively in a front view and a top view of cross-section C-C, a first body element 1.1 of the device 1, which comprises a deflector with a first deflecting surface 31.1 and a first opening 32.1 of the device 1. The first body element 1.1 comprises a body element inlet 1.1*i*, a central axis 1.1*a*, and a body element outlet 1.10.

As is indicated in FIG. 1*c*, for forming the device 1 according to the first embodiment of the device 1 shown in FIGS. 1*d,f-i*, the first concentrator element 1.1 is inserted with a downstream part 1.1*d* thereof into a second concentrator element 1.2. The second concentrator element 1.2 is identical with the first concentrator element 1.1, and comprises a second deflecting surface 31.2 and a second bypass opening 32.2. The concentrator elements 1.1 and 1.2 are successively arranged in the intended flow direction 90*f* such that their axes 1.1*a* collide to form the axis 1*a* of the device 1. The second concentrator element 1.2 is angularly arranged with respect to the first concentrator element 1.1 such that the deflecting surfaces are angularly offset from one another by an angle of 180° around the axis 1*a*—see the top views of cross-sections C-C of the elements 1.1, 1.2 in FIG. 1*c*, of cross-sections C-C and D-D through the device in FIG. 1*g* and the top views of the device 1 in FIGS. 1*d,i*. As may also be verified therefrom, the downstream axial part 1.1*d* of the first concentrator element 1.1 is arranged concentrically inside the successive second concentrator element 1.2.

The inlet element 1.1*i* of the first concentrator element 1.1 forms the inlet element 10 of the device 1. The inlet element 1.1*i*, and therefore, the inlet element 10, is formed by a circumferential flange at the upstream end of the first concentrator element 1.1. The outlet element of the second concentrator element 1.2 forms the outlet element 20 of the device 1.

The outlet element 20 defining a cylindrical internal space over an axial length 20*h* is provided for rectifying the flow of the particles 92 and the fluid 91 to follow parallel stream lines—i.e. for synchronizing the flow directions of the fluid 91 and the particles 92.

The spacer element 40 in the form of a hollow, short tube is arranged between the inlet element 1.1*i* of the first concentrator element 1.1 and the inlet of the second concentrator element 1.2. The spacer element 40 is shown individually in FIG. 1*k* and has an axial length 40*h* of approximately 13 mm, so as to maintain an axial distance between the inlets of the body elements 1.1 and 1.2 such that in the device 1, the radial distance between the deflecting surfaces 31.1 and 31.2 is at least five times the particle diameter of 1 mm. As shown in FIGS. 1*d,f-i* the first axial section 30.1 of the device 1 is formed only by an upstream part 1.1*u* of the first concentrator element 1.1 which protrudes above the second concentrator element 1.2. The axial length 40*h* of the spacer element 40 determines the axial length of the first axial section 30.1. The second axial section 30.2 is formed by the second concentrator element 1.2, and additionally by the downstream part 1.1*d* of the first concentrator element 1.1.

As visible from the top views of the cross-sections C-C in FIG. 1*c* of the body elements 1.1, 1.2 and from the top views of the cross-sections C-C and D-D of the device 1 in FIG. 1*g*, the deflecting surfaces 31.1, 31.2 together extend over a majority of the angular range around the central axis 1*a*—the respective angular zones 30α1 and 30α2 are diametrically opposite and together extend over around 350 degrees.

The angular zones 30α1, 30α2 over which the directing surfaces 31.1, 31.2 of both respective axial sections extend, are thus slightly smaller than the angular zones 30β1, 30β2 over which the bypass openings 32.1, 32.2 extend. Furthermore, the angular zones 30α1, 30α2 are respectively completely inside the angular zones 30β2, 30β1, so that the bypass openings 32.1, 32.2 overlap over angular zones 32βo of around 5°, resulting in corresponding axial slits 32*o* of the device 1.

In the first embodiment, the remaining part 90*r* of the stream 90 is thus discharged from the device 1 through the bypass openings 32.1, 32.2 partly via the annular space between the concentrator elements 1.1, 1.2 and partly directly via angular slits 32*o*.

The outlet elements 1.1*o* of the concentrator elements 1.1, 1.2 are provided with an axially and tangentially bounded opening. The opening in the outlet element 1.1*o* of the first concentrator element 1.1 enables particles 92 between the outlet element 1.1*o* of the first concentrator element 1.1 and the deflecting surface 31.2 of the second concentrator element 1.2 to move into the outlet element 20 of the device 1 such as to end up in the target stream part 90*t*, thereby substantially preventing accumulation of these particles 92 between the outlet element 1.1*o* and the deflecting surface 31.2.

The outlet element 20 is provided with a shape adapter element 21 enclosing the outlet element 20. It is shown dashed in FIG. 1*c* on the second concentrator element as it is only provided to the outlet element of the second body element 1.2 in the first embodiment and not in the second embodiment. The shape adapter element 21 is shown individually in FIGS. 1*j* and is by its shape configured to convert the cross-section 90*ct* of the target stream portion 90*t* of the stream 90 from a substantially circular shape to a substantially square shape. The target part 90*t* is enabled to spread over the square shaped cross-section by means of the opening in the outlet element 20. As is illustrated in FIG. 5*d*, the square shaped cross-section of the target part 90*t* discharged from the shape adapter element 21 enables that movement of an inlet of a channel ch1, or of another part or device, which is to be arranged downstream of the outlet element 20 and the adapter element 21, with a corresponding square or rectangular cross-section linearly along an edge of the square causes this inlet to overlap with the now square shaped target part 90*t* with a cross-sectional area that scales linearly with the movement. As a result, an amount of particles 92 received of the concentrated target stream part 90*t* can be adjusted linearly by the movement of the channel ch1. This possibility may make regulation of the amount of particles 92 flowing into the channel ch1 more predictable and accurately controllable. Such regulated inflow of particles 92 into a downstream channel ch1 may be desired in applications of abrasive jet drilling, wherein modulation of the concentration of the abrasive particles 92 is used to obtain a difference in the erosive power between azimuthal sections of a borehole for directing the borehole towards the less eroded azimuthal section. This will be discussed below in relation to FIGS. 5*a-c* and 6*a-e*.

As is indicated in FIG. 1*c*, for forming the device 1 according to the second embodiment of the device 1 shown in FIG. 1*e*, the first concentrator element 1.1 is inserted with a downstream part 1.1*d* thereof into the second concentrator element 1.2, which is in turn inserted with a downstream part 1.2*d* thereof inserted into a third concentrator element 1.3 which is identical with the first and second concentrator elements 1.1, 1.2. Thus, the second embodiment corresponds to the first embodiment, with the addition of the third concentrator element 1.3. The third concentrator element 1.3 comprises a third deflector with a third deflecting surface 31.3 and a third bypass opening 32.3. The concentrator elements 1.1, 1.2 and 1.3 are successively arranged in the intended flow direction 90*f* such that their axes 1.1*a* collide to form the axis 1*a* of the device 1. From the top views of cross-sections C-C of the concentrator elements 1.1, 1.2 in FIG. 1*c*, the third concentrator element 1.3 is angularly arranged correspondingly to the first concentrator element 1.1, so that the deflecting surface 31.3 thereof is angularly offset from the second deflecting surface 31.2 by an angle of approximately 180° around the axis 1*a*. Alike the arrangement of the first and second concentrator elements 1.1, 1.2, the downstream axial part 1.2*d* of the second concentrator element 1.2 is also arranged concentrically inside the successive third concentrator element 1.3.

The inlet element 1.1*i* of the first concentrator element 1.1 again forms the inlet element 10 of the device 1 according to the second embodiment. The outlet element of the third body element 1.3 forms the outlet element 20 of the device 1, and rectifies the flow of the particles 92 and the fluid 91 to follow parallel stream lines. In addition to the spacer element 40 between the inlets of the first and second concentrator element 1.1, 1.2, a spacer element 40 according to FIG. 1*k* is also arranged between the inlet elements of the second and third concentrator element 1.2, 1.3 so as to maintain an axial distance also between the inlets of these concentrator elements 1.2 and 1.3. As a result in the device 1, the radial distance between the deflecting surfaces 31.1 and 31.2, and between the deflecting surfaces 31.2 and 31.3, is at least five times the particle diameter of 1 mm. The axial length 40*h* of the spacer element 40 determines the axial length of both the first and second axial section 30.1, 30.2.

As shown in FIG. 1*e*, the first axial section 30.1 of the device 1 is formed only by an upstream part 1.1*u* of the first concentrator element 1.1 which protrudes above the second concentrator element 1.2. The intermediate, second axial section 30.2 is formed by the upstream axial part 1.2*u* of the second concentrator element 1.2 and part of the downstream axial part 1.1*d* of the preceding, first concentrator element 1.1. The third axial section 30.2 is formed by the third concentrator element 1.3, and additionally by the part of the downstream part 1.1*d* of the first concentrator element 1.1 and by the downstream part 1.2*d* of the second concentrator element 1.2.

As derivable from the top views of the cross-sections C-C in FIG. 1*c* of the concentrator elements 1.1, 1.2, 1.3, the deflecting surfaces 31.1, 31.2, 31.3 together extend over a majority of the angular range around the axis 1*a*—the respective angular zones 30α1, 30α2, 30α3 are diametrically opposite and together extend over around 350 degrees—alike in the first embodiment since the angular zones 30α1, and 30α3 are arranged to correspond to one another. Correspondingly, again the angular zones 30α1, 30α2, 30α3 over which the deflecting surfaces 31.1, 31.2, 31.3 of the three respective axial sections 30.1, 30.2, 30.3 extend, are smaller than the angular zones 30β1, 30β2, 30β3 over which the bypass openings 32.1, 32.2, 32.3 extend and the angular zones 30α1, 30α2, 30α3 are respectively completely inside the angular zones 30β2, 30β1, 30β2—wherein 30β1 corresponds to 30β3. Thus also in this embodiment the bypass openings 32.1, 32.2, 32.3 overlap over angular zones 32β*o* of around 5°, resulting in corresponding axial slits 32*o* of the device 1.

The remaining part 90*r* of the stream 90 is thus discharged from the device 1 through the bypass openings 32.1, 32.2, 32.3 partly via the annular spaces between the concentrator elements 1.1, 1.2, 1.3 and partly or directly or indirectly via angular slits 32*o*.

As explained in relation to the first embodiment the opening in the outlet elements 1.1*o* of the first and second concentrator element 1.1, 1.2 substantially prevent accumulation of particles 92 between the respective outlet element 1.1*o* and the respective deflecting surface 31.2, 31.3. The outlet element 20 is again provided with the shape adapter element 21.

For the third embodiment, FIGS. 2*a,b* show, respectively in a front view and a top view of cross-section C-C, a first concentrator element 1.1 of the device 1, which comprises four deflectors, having four first deflecting surfaces 31.1, and four first bypass openings 32.1 of the device 1. The first concentrator element 1.1 comprises an inlet element 1.1*i*, an axis 1.1*a*, and a outlet element 1.1*o*.

As is indicated in FIG. 2*c*, for forming the device 1 according to the third embodiment of the device 1 shown in FIGS. 2*d-f*, the first concentrator element 1.1 is inserted with a downstream part 1.1*d* thereof into a second concentrator element 1.2, which is in turn inserted with a downstream part thereof into a third concentrator element 1.3. The second and third concentrator elements 1.2, 1.3 are identical with the first concentrator element 1.1. The second concentrator element 1.2 comprises four second deflectors, having second directing surfaces 31.2, and four second bypass openings 32.2. The third concentrator element 1.3 comprises four third deflecting surfaces 31.3 and four third bypass openings 32.3. The concentrator elements 1.1, 1.2 and 1.3 are successively arranged in the intended flow direction 90*f* such that their axes 1.1*a* collide to form the axis 1*a* of the device 1. The second concentrator element 1.2 is angularly arranged with respect to the first concentrator element 1.1 such that the deflecting surfaces are angularly offset from one another by an angle 30αs of 45° around the axis 1*a*—see the top views of cross-sections C-C of the concentrator elements 1.1, 1.2, 1.3 in FIG. 2*c* and the top views of the device 1 in FIG. 2*f*. As may also be verified therefrom, the downstream axial parts of the first and second concentrator elements 1.1, 1.2 are arranged concentrically inside the successive second and third concentrator elements 1.2, 1.3, respectively.

As with the first and second embodiment, also here the inlet element 1.1*i* of the first concentrator element 1.1 forms the inlet element 10 of the device 1. The outlet element of the third body element 1.3 forms the outlet element 20 of the device 1. The outlet element 20 of the device 1 defining a cylindrical internal space over an axial length 20*h* is provided for rectifying the flow of the particles 92 and the fluid 91 to follow parallel stream lines.

As shown in FIG. 2*c* the spacer element 40 is arranged between the inlet element 1.1*i* of the first concentrator element 1.1 and the inlet element of the second concentrator element 1.2 and between the inlet elements of the second and third concentrator elements 1.2, 1.3 for maintaining an axial distance between the inlet elements of the concentrator elements 1.1, 1.2, 1.3 such that in the device 1, the radial distance between the deflecting surfaces 31.1 and 31.2 is at least five times the particle diameter of 1 mm. As shown best in FIG. 2*d* the first axial section 30.1 of the device 1 is formed only by an upstream part 1.1*u* of the first concentrator element 1.1 which protrudes above the second concentrator element 1.2. The axial length 40*h* of the spacer element 40 determines the axial length of the first and second axial sections 30.1, 30.2. The intermediate second axial section 30.2 is formed by the second concentrator element 1.2, and additionally by part of the downstream part 1.1*d* of the first concentrator element 1.1. The third axial section 30.2 is formed by the third concentrator element 1.3, and additionally by part of the downstream part 1.1*d* of the first element 1.1 and the downstream part of the second body element 1.2.

As visible from the top views of the cross-sections C-C in FIG. 2*c* of the concentrator elements 1.1, 1.2 and from the top views of the cross-sections C-C and D-D of the device 1 in FIG. 1*g*, the deflecting surfaces 31.1, 31.2 together extend over a majority of the angular range around the central axis 1*a*—the respective angular zones 30α1 and 30α2 are diametrically opposite and together extend over around 340 degrees.

The angular zones 30α1, 30α2, 30α3 over which the deflecting surfaces 31.1, 31.2, 31.3 of the three respective axial sections 30.1, 30.2, 30.3 extend, are also in this embodiment smaller than the angular zones 30β1, 30β2, 30β3 over which the bypass openings 32.1, 32.2, 32.3 extend. Furthermore, the angular zones 30α1, 30α2, 30α3 are respectively completely inside the angular zones 30β2, 30β1, 30β2—wherein 30β1 corresponds to 30β3—so that the bypass openings 32.1, 32.2 overlap over angular zones 32βo of around 5°, resulting in corresponding axial slits 32*o* of the device 1.

In the third embodiment, the remaining part 90*r* of the stream 90 is thus discharged from the device 1 through the bypass openings 32.1, 32.2, 32.3, partly via the annular space between the concentrator elements 1.1, 1.2 and partly directly and indirectly via angular slits 32*o*.

The outlet elements 1.1*o* of the concentrator elements 1.1, 1.2, 1.3 are provided with multiple axially and tangentially bounded and angularly regularly spaced openings. The opening in the outlet element 1.1*o* of the first concentrator element 1.1 enables particles 92 between the outlet element 1.1*o* of the first concentrator element 1.1 and the second deflecting surfaces 31.2 of the second concentrator element 1.2, and between the outlet element of the second concentrator element 1.2 and the third deflecting surfaces 31.3 to move into the outlet element 20 of the device 1 such as to end up in the target stream part 90*t*, thereby substantially preventing accumulation of these particles 92 between the outlets of the first and second concentrator elements 1.1, 1.2 and the respective deflecting surfaces 31.2, 31.3.

The outlet element 20 of the device 1 is provided with the shape adapter element 21 enclosing the outlet element 20 for converting the cross-section 90*ct* of the target stream part 90*t* of the stream 90 from a substantially circular shape to a substantially square shape. The target part 90*t* is enabled to spread over the square shaped cross-section by means of the openings in the outlet element 20.

In the first, second, and third embodiment, the deflecting surfaces 31.1, 31.2, 31.3 of each one of the axial sections 30.1, 30.2, 30.3 are angularly movable relative to the deflecting surfaces 31.1, 31.2, 31.3 of the other ones of the axial sections 30.1, 30.2, 30.3 by an angularly displacing axial sections 30.1, 30.2, 30.3 relative to one another. This is achieved by angularly displacing the respective concentrator elements 1.1, 1.2, 1.3 relative to one another.

For example, in relation to the third embodiment, the deflecting surfaces 31.1, 31.2, 31.3 are angularly spaced by an angle 31αs of 45°. One or more of the concentrator elements 1.1, 1.2, 1.3 of the device 1 may be rotated around axis 1*a* relative to one or more other ones of the concentrator elements 1.1, 1.2, 1.3 such as to change one or more of the angular spacing angle(s) 31αs and one or more of the angle(s) of the angular zones 32βo over which the axial slits 32*o* extend. When the angular zones 32βo are increased by the rotating, the chance that particles 92 escape through the slits 32*o* is increased, so that a larger part of the particles 92 in the stream 90 will end up in the remaining part 90*r* of the stream 90, and a smaller part of the particles 92 in the target part 90*t*. Thus, the concentration difference of the particles 92 between the remaining part 90*r* and the target part 90*t* will be reduced, and therefore the extent of the concentrating effect of the device 1 towards the target part 90*ct* of the cross-section 90*c* of the stream 90. Vice versa, by decreasing the angular zones 32βo less particles 92 will escape through the slits 32*o* to end up in the remaining part 90*r* whereas more particles 92 will end up in the target part 90*t*, such as to increase the concentration difference between the stream parts 90*r*, 90*t*, and increase the effectiveness of the device 1. The same principle applies to the first and second embodiment.

The invention also relates to the concentrator element 1.1 shown in relation to either embodiment—even as variations derivable therefrom which are within the scope of the invention.

A fourth, constructionally simple embodiment is shown in FIGS. 3*a*-*d*. This embodiment has a body 30 with two axial sections 30.1, 30.2, each with one respective deflector, having a respective deflecting surface 31.1, 31.2, and one respective bypass opening 32.1, 32.2. The inlet element 10, outlet element 20 and shape converter 21 are the same as in the first three embodiments—evenas the mentioned dimensions 10*di*, 10*do*, 10*c*, 20*di*, 10*h*, 20*di*, 20*h* thereof. The axial length 30*h* of the body 30 is approximately 55 mm. The angular zone 30α1 over which the first deflecting surface 31.1 extends is slightly larger than 1800 and the angular zone over which the second deflecting surface 31.2 extend is smaller than 180°. Together they again extend over the majority of the 360° angular range around the central axis 1*a*, namely over around 350°. The angular zones 30β1 and 30β2 over which the openings 32.1, 32.2 extend overlap over the angular zone 30βo.

Eventually, e.g. to enhance or reduce the concentrating effect, this embodiment may also be used as a single concentrator element, into which other, e.g. identical, concentrator elements are inserted in the way shown for the first three embodiments to form another embodiment of the device 1.

The device 1 according to either embodiment may be used in a method according to the invention as described herein.

Other embodiments of the device 1 may be envisaged from the figures—e.g. with more or less concentrator elements, more or less, or differently dimensioned or mutually spaced deflecting surfaces and bypass openings per axial section, non-concentric or (rotationally) non-symmetric arrangements of the concentrator elements, an axis not parallel to, but at an angle with the flow direction, etc., which suit the intended purpose and stream properties.

As mentioned, in FIGS. 4*a-c* a use of the first embodiment is shown being arranged inside a tube 80, and connected therewith at the inlet. Therein the particles 92 are sphere-shaped abrasive particles 92 with a diameter of approximately 1 mm, and the fluid is drilling fluid 91. The six example particles 92.1, 92.2, 92.3, 92.4, 92.5, 92.6 with exaggerated size illustrate how particles may end up either in the remaining part 90*r* of the stream 90 or the target part 90*t*. These examples do not represent an average of the behavior of the gross of the particles 92 in the stream 90—and are only shown for illustration of a few possibilities. It is shown that the target part 90*t* and remaining part 90*r* are discharged to continue downstream of the device and inside the tube 80 as a stream composed of the target part 90*t* and remaining part 90*r*, wherein the remaining part 90*r* encircles the target part 90*t*.

Because of their large Stokes number in the drilling fluid 91, the movement of the particles 92 is dominated by their inertia, though still influenced by the stream lines of the stream 90.

Particle 92.1 is by the impact with the first deflecting surface 31.1 in the first axial section 30.1 deflected inwardly towards the outlet element 1.1*o* of the first concentrator element 1 and bows off to the stream lines of the stream 90 to end up in the outlet element 20 of the device 1 and thus in the target portion 90*t* of the stream 90.

Particle 92.2 hits the first deflecting surface 31.1 quite far downstream in the downstream part 1.1*d* of the first concentrator element 1.1 in the second axial section 30.2 and happens to be redirected such that it passes the opening in the outlet element 1.1*o* of the first concentrator element 1.1 from the inside towards the annular space between the second deflecting surface 31.2 and consequently the outlet element 1.1*o*. By subsequently colliding with the second deflecting surface 31.2 at its downstream edge it is deflected via the annular space between the outlet element 1.1*o* and the second deflecting surface 31.2 into the remaining portion 90*r* of the stream 90.

Particle 92.3 is located halfway the radius of the stream 90 when entering the device 1 and is by a slight deflection due to a collision with another particle 92 pushed into an axial slit 300 to be discharged from the device 1 in the remaining portion 90*r* of the stream 90.

Particle 92.4 is deflected far downstream by impacting the second deflecting surface 31.2, such that it moves into outlet element 1.1*o* of the first concentrator element 1.1 via the bypass opening thereof, subsequently into the outlet element 20 of the device 1 where it moves through the lateral opening of the outlet element 20 against the wall of the shape converter 21, and is discharged from the device 1 in the target portion 90*t* of the stream 90—of which the cross-sectional shape is converted into a square by the shape converter 21 as shown.

Particle 92.5 is by the impact with the second deflecting surface 31.2 halfway the axial length of the device 1 in the second axial section 30.2 deflected inwardly towards the outlet element 1.10 of the first concentrator element 1 and bows off to the stream lines of the stream 90 to end up in the outlet element 20 of the device 1 and in the target portion 90*t* of the stream 90.

Particle 92.6 hits simultaneously another particle 92 and the second deflecting surface 31.2 at the corner of its upstream tangential edge with the inlet of the second concentrator element 1.2 and takes a sharp turn along the second deflecting surface 31.2 and through the second bypass opening 32.2 outwards from the first deflecting surface 31.1 to end up in the remaining portion 90*r* of the stream 90.

Of course, numerous other flow trajectories of the particles 92 are possible—the shown trajectories are only some special cases.

FIG. 5 illustrates the use of the device 1 in a sub 2 of an abrasive jet drilling system. Here, the device 1 is represented by simple contour lines only. FIG. 6*a* illustrates the sub 2 in a system 8 for abrasive jet drilling. The sub 2 is connected at a downhole end thereof via a recirculation sub 5 to a drill bit 3 of the system so as to be rotatable along therewith. At another end thereof the sub 2 is connected to a tubular drill string 4 of the system. The system is shown during a method of directional drilling of a curved borehole 6*a* in a subterranean earth formation 2. The drilling has progressed through limestone layer 7*a* and sandstone layer 7*b* into a rock layer 7*c* of the subterranean earth formation. The drill string 4 is rotated by top drive 9*b* of drilling tower 9*a* at the surface 7*d*. Within the cement casing of a main, vertical borehole 6, an anchor 3*c* is arranged and a whipstock 3*d*, which guides the drill string 4 through the casing to deviate into borehole 4*a*. Borehole 6*a* is the last of four curved boreholes 6*a*, 6*b*, 6*c*, 6*d* deviating from the main borehole 6 being drilled. All deviating curved boreholes 6*a*, 6*b*, 6*c*, 6*d* comprise a curved section and a subsequent straight section. The directional drilling system 8 is shown while deepening the straight section of borehole 6*a*. Borehole 6*a* has a borehole bottom 6*a'*.

At the surface 7*d*, besides the tower 9*a* and top drive 9*b*, a pump 98 is provided which pumps the drilling fluid 91 through a particle injection device 99. In particle injection device 99, abrasive particles 92 from an abrasive particles supply 95 are combined with the drilling fluid 91 to form the stream 90 of drilling fluid 91 mixed with abrasive particles 92. The stream 90 has a substantially constant flow rate and concentration of abrasive particles 92. The stream 90 is passed through a supply channel that runs through the drill string 4 into the system 8, inside which it runs subsequently through the steerable sub 4 and a recirculation sub 5 and drill bit 3. The drill bit 3 is in this case an abrasive jet drill bit. After passing the drill bit 3, the stream 90 impinges the borehole bottom 6*a*' in the form of an abrasive jet of said stream 90, so as to erode the borehole bottom 6*a*'. After this impingement, the stream 90 progresses upwardly again towards the surface 7*d*, moving in between the annular space in between the cylindrical borehole wall and the system 8. While passing the recirculation sub 5, a portion of the abrasive particles 92 inside the stream 90 is captured from the annulus by the recirculation sub 5, and recirculated within the recirculation sub as a recirculation stream 93 to the stream 90. After the capture of the abrasive particles 92, the stream 90 progresses further towards the surface as return stream 94. The particles 92 still left in the recirculation stream 94 are filtered at the surface 7*d* to join the supply 95 of abrasive particles 92.

FIGS. 6*b* and 6*c* show, schematically, two possible embodiments of an abrasive jet drilling system 8. Both have the steerable sub 2, the interior of which is shown schematically in FIG. 6*d* in a magnification. In the system 8 of FIG.

6*b*, the drill bit 3 is a mechanical drill bit. In FIG. 6*c*, the drill bit 3 is an abrasive jet drill bit, and the system 8 comprises the recirculation unit 5. The mechanical drill bit comprises abrasive nozzle 3*a*, washer nozzle 3*w*, and cutters 3*c*. The abrasive jet drill bit comprises only an abrasive nozzle 3*a*.

The device 1 is shown provided in, and upstream of the drill bit 3 in the two respective, schematic, details in FIG. 6*b*, and is directed to the abrasive nozzle 3*a* so that the target part 90*t* of the stream 90 as received from the sub 2 via drill bit inlet 3*i* as discharged from the outlet 20 of the device 1 is directed into the abrasive jet nozzle 3*a*. When upstream of the drill bit 3, a hose catches the target stream with the high- and low concentration stream portions 90*h*, 901 from the outlet element 20 and guides it towards the abrasive jet nozzle 3*a*. Similarly, the device 1 may be provided upstream of, or in the abrasive jet drill bit, directing the target part 90*t* of the stream 90 as received from the recirculation sub 5 into the abrasive jet nozzle 3*a* thereof. This is shown in FIGS. 6*e* and 6*f*, also illustrating the alignment of the device with the borehole bottom section 6*a*" which needs enhanced erosive power. The target part 90*t* of the stream 90 discharged by the outlet element 20 of the device 1 and containing the stream portions 90*l*, 90*h* is directed into the nozzle 3*a* in dependence of an azimuthal position of the nozzles such as to modulate the extent of erosion of a borehole bottom 6*a*' along azimuthal positions thereof.

In FIG. 6*d*, the device 1 is shown being provided in the sub 2 of the system 8, upstream of a first channel ch1 inside a second channel ch2. The inlet 10 of the device 1 receives the stream 90 of drilling fluid 91 and abrasive particles 92 from the drill string 4. As depicted by FIGS. 5*a-d*, by alternately aligning and not aligning the first channel 1 with the outlet element 20 of the device 1, high concentration stream portions 90*h* and low concentration stream portions 90*l* are alternatingly created such that these are ejected by the nozzle 3*a* of the drill bit 3 when azimuthally within a section of the borehole bottom 6*a*' which needs respectively enhanced or reduced erosive power—see FIG. 6*e*.

FIGS. 5*a-d* illustrate that the creation of the high and low concentration stream portions 10*h* and 10*l* is based on directing portions 90*t*.1, 90*t*.2, 90*t*.3, 90*t*.4, 90*t*.5, 90*t*.6, 90*t*.7, 90*t*.8 of the target part 90*t* discharged by the outlet element 20 of the device 1 alternatingly through the first channel ch1 and the second channel ch2, and portions 90*r*.1, 90*r*.2, 90*r*.3, 90*r*.4, 90*r*.6, 90*r*.7, 90*r*.8 of the remaining part 90*r*. Therein due to the larger cross-sectional area of the second channel ch2 relative to the first channel ch1 the target part portions 90*t*.4, 90*t*.6, 90*t*.8 move through the second channel ch2 at a larger velocity than the target part portions 90*t*.1, 90*t*.3, 90*t*.5, 90*t*.7, 90*t*.9 move through the first channel ch1. As a consequence the target part portions arrive together at the outlets of the channels ch1, ch2 to together combine to a high concentration stream portions 90*h*. As shown the target part portion 90*t*.1 combines with the target part portion 90*t*.4. Target part portion 90*t*.2 is here already downstream of 90*t*.1 and therefore not visible anymore. Similarly, the remaining part portions 90*r*.1, 90*r*.2, 90*r*.3, 90*r*.4, 90*r*.6, 90*r*.7, 90*r*.8 combine to low concentration stream portions 90*l* at the channel outlets. This principle of generating the high and low concentration stream portions for directional drilling is disclosed in NL2024001.

Here, the aligning and not aligning of the first channel ch1 is actuated by a linear motor 2*m* of the sub 2 pulling and releasing the inlet end of the channel ch1 via a connected cable 2*c* led over sheave 2*cs*, counteracted by spring 2*s*, such as to pivot the channel ch1 out of and into alignment with the outlet 20 of the device, respectively, around a pivot axis at the outlet end. FIGS. 5*b* and 5*c* illustrate alignment and non-alignment of the inlet of the first channel ch1 resulting from the pivoting.

The invention claimed is:

1. An assembly comprising:

a circumferential enclosure for accommodating a stream of a fluid mixed with particles, the stream having a cross-section defined by the circumferential enclosure transverse to a flow direction of the stream; and a particle concentrating device that extends around an axis parallel to the flow direction, and that is arranged inside and connected to the circumferential enclosure, wherein the particle concentration device is configured for increasing a concentration of the particles in a target area of the cross-section of the stream, the target area being defined by an outlet of the particle concentrating device arranged at a downstream end thereof and having a cross-section corresponding to the target area, wherein the device is arranged inside the circumferential enclosure to discharge within the circumferential enclosure the stream as being composed of a target part, discharged by the outlet, and a remaining part, wherein the particle concentrating device comprises multiple deflectors, the deflectors each having a deflecting surface, and wherein the deflecting surfaces:

are arranged about the axis, slanting in the flow direction in a direction from the circumferential enclosure towards the axis, for deflecting a part of the particles towards the axis, and thus towards the target area;

extend over respective angular zones of the device with respect to the axis, the angular zones each being defined by side edges of the respective deflecting surface, the deflecting surfaces together extending over a collective angular zone between the angularly most remote side edges thereof, the angular zone covering a majority of the angular range around the axis; and define between the side edges thereof one or more bypass openings which thereby extend over angular zones complementary to the angular zones over which the deflecting surfaces extend, wherein, in operation of the device, the deflecting surfaces together are configured for forming the target part discharged by the outlet of the device, and wherein the bypass openings are together configured for discharging the remaining part of the stream between the circumferential enclosure and the outlet, and wherein respective ones of the deflectors are part of multiple concentrator elements of the device which are successively arranged in the flow direction, wherein each concentrator element has one or more of the deflectors, or wherein the deflectors are all part of a single concentrator element.

2. The assembly according to claim 1, wherein the circumferential enclosure is suitable for accommodating a stream of drilling fluid mixed with abrasive particles.

3. The assembly according to claim 1, wherein the side edges of each deflecting surface extend in an axial plane comprising the axis.

4. The assembly according to claim 1, wherein the device comprises multiple axial sections, including at least an upstream axial section and a downstream axial section, wherein each deflecting surface and each opening axially extends along at least one respective axial section, and wherein over the downstream axial section at least one of the deflecting surfaces extends, the at least one of the deflecting surfaces being distinct from each deflecting surface extending over the upstream axial section and extending over an angular zone that is distinct from an angular zone over which a deflecting surface extending along the upstream axial section extends.

5. The assembly according to claim 4, wherein the device comprises for each axial section a respective concentrator element, of which the respective deflectors have the deflecting surfaces extending over each respective axial section.

6. The assembly according to claim 5, wherein the separate concentrator elements are at least geometrically substantially equal to one another.

7. The assembly according claim 1, wherein the concentrator elements of the device are nested along the axis, and wherein at least a most upstream one of the concentrator elements is with a downstream axial part thereof inserted into a downstream one of the concentrator elements, such that an upstream axial part of the upstream concentrator element protrudes from the downstream concentrator element, and, if present, forms the upstream axial section.

8. The assembly according to claim 7, wherein the downstream axial part is arranged concentrically inside the upstream axial part of the downstream concentrator element.

9. The assembly according to claim 1, wherein the deflecting surfaces of the device together extend over at least a majority of the angular range around the axis.

10. The assembly according to claim 1, wherein the deflecting surfaces and the one or more bypass openings of each of the concentrator elements, define between them a frustum around the axis, the target area forming the top of the frustum.

11. The assembly according to claim 10, wherein the frustum is a conical frustum rotationally symmetric with respect to the axis.

12. The assembly according to claim 1, wherein the deflecting surfaces in each concentrator element are exactly one deflecting surface, and wherein the number of concentrator elements is exactly two or three.

13. The assembly according to claim 12, wherein the angle of the angular zone over which each deflecting surface extends is between 140 and 200 degrees.

14. The assembly according to claim 1, wherein the deflecting surfaces in each concentrator element are exactly four deflecting surfaces, and wherein the number of concentrator elements is exactly two or three.

15. The assembly according to claim 1, wherein the particle concentrating device comprises the multiple concentrator elements, and the respective concentrator elements are angularly movable relative to one another so that the deflecting surfaces are angularly displaceable relative to one another.

16. The assembly according to claim 15, wherein the device further comprises one or more actuators, operative between the concentrator elements, and configured for angularly displacing the associated deflecting surfaces relative to one another.

17. The assembly according to claim 1, wherein the particles have an effective diameter in the range of 0.8-1.2 mm, and wherein the openings each have a smallest diameter larger than at least approximately three times a largest diameter of the particles.

18. The assembly according to claim 1, wherein the target area is within a center portion of the cross-section of the stream, so that the target portion of the stream as discharged by the device is encircled by the remaining portion.

19. A particle concentrating device, configured for use in the assembly according to claim 18, wherein the circumferential enclosure is a tube of a drill string, or an internal space of a drill bit, the concentrating device being configured to extend around an axis parallel to the flow direction, for being arranged inside and connected to the circumferential enclosure, wherein the particle concentration device is configured for increasing a concentration of the particles in a target area of the cross-section of the stream, the target area being defined by an outlet of the particle concentrating device arranged at a downstream end thereof and having a cross-section corresponding to the target area, wherein the device is arranged inside the circumferential enclosure to discharge within the circumferential enclosure the stream as being composed of a target part, discharged by the outlet, and a remaining part, wherein the particle concentrating device comprises multiple deflectors, the deflectors each having a deflecting surface, and wherein the deflecting surfaces:

are arranged about the axis, slanting in the flow direction in a direction from the circumferential enclosure towards the axis, for deflecting a part of the particles towards the axis, and thus towards the target area;

extend over respective angular zones of the device with respect to the axis, the angular zones each being defined by side edges of the respective deflecting surface, the deflecting surfaces together extending over a collective angular zone between the angularly most remote side edges thereof, the angular zone covering a majority of the angular range around the axis, and define between the side edges thereof one or more bypass openings which thereby extend over angular zones complementary to the angular zones over which the deflecting surfaces extend, wherein, in operation of the device, the deflecting surfaces together are configured for forming the target part discharged by the outlet of the device, and wherein the bypass openings are together configured for discharging the remaining part of the stream between the circumferential enclosure and the outlet, and wherein respective ones of the deflectors are part of multiple concentrator elements of the device which are successively arranged in the flow direction, wherein each concentrator element has one or more of the deflectors, or wherein the deflectors are all part of a single concentrator element.

20. A method for increasing a concentration of particles in a circumferentially enclosed stream of a fluid mixed with the particles, in a target area of a cross-section of the stream transverse to a flow direction of the stream, the method comprising the steps of:

providing the stream of the fluid mixed with the particles;

providing deflecting surfaces and arranging the deflecting surfaces in the stream, such that the deflecting surfaces:

extend over respective angular zones with respect to an axis through the target area of the stream cross-section;

slant in the flow direction in a direction from the circumference of the stream towards the target area; and define angularly in between them multiple bypass openings, which extend over angular zones complementary to the angular zones over which the deflecting surfaces extend, and which each have a smallest diameter larger than an effective diameter;

deflecting, by means of the deflecting surfaces at least a part of the particles inwardly towards the axis; and discharging a target part of the stream with the target cross-section around the axis, and discharging, through the openings, a remaining part of the stream between the target part and the circumference of the stream, such as to discharge the stream as composed of the target part and the remaining part.

21. The method according to claim 20, further comprising the step of using a particle concentrating device, wherein the step of providing deflecting surfaces and arranging the deflecting surfaces comprises arranging the device in the stream by connecting the device to a circumferential enclosure of the stream.

22. The method according to claim 20, further comprising the step of using a particle concentrating device, the particle concentrating device comprising multiple concentrator elements, the method comprising, prior to the step of deflecting, the step of assembling the device, the step of assembling comprising the steps of:

arranging two or more of the multiple concentrator elements successively in the flow direction; and angularly arranging the two or more of the multiple concentrator elements with respect to one another such that the deflecting surfaces are at least partially angularly offset from one another to together extend over a collective angular zone covering at least a majority of an angular range around the axis.

23. The method according to claim 22, further comprising the step of modulating an extent of an increase of the concentration of the particles in the target area of the cross-section of the stream, the step of modulating further comprising the steps of:

arranging one or more of the multiple concentrator elements along the flow direction in precession or succession to the two or more of the multiple concentrator elements of the device; and/or angularly moving one or more of the multiple concentrator elements with respect to one or more other of the multiple concentrator elements such as to increase or decrease the total angular range around the axis over which the angular zones over which the deflecting surfaces of the concentrator elements together extend.

24. The method according to claim 20, wherein the fluid is a drilling fluid and the particles are abrasive particles for abrasive jet drilling, with an effective diameter of 0.8-1.2 mm.

25. A method for directional drilling comprising the steps of the method according to claim 24, further comprising the step of varying the extent of erosion of a borehole bottom along azimuthal positions thereof, comprising selectively directing the target part of the stream into impingement with the borehole bottom at a determined range of the azimuthal positions in the form of an abrasive jet.

26. The method according to claim 25, wherein the varying of the extent of erosion of a borehole bottom is performed in a drill bit, by selectively directing, in dependence of an azimuthal position of one or more abrasive jet nozzles of the drill bit which move along the azimuthal positions of the borehole bottom, at least the target part of the stream towards the one or more of the nozzles:

by stationarily directing the target part of the stream towards the determined azimuthal range and aligning the one or more of the nozzles with the directed target part only when the one or more of the nozzles are within the determined azimuthal range; or by moving the target part of the stream along with the one or more of the nozzles along the azimuthal positions of the borehole bottom and directing the target part into the one or more of the nozzle, by alignment therewith, only when the one or more of the nozzles are within the determined azimuthal range.

* * * * *